US012111114B2

(12) United States Patent
Huang et al.

(10) Patent No.: US 12,111,114 B2
(45) Date of Patent: Oct. 8, 2024

(54) HEAT TRANSFER ELEMENT, METHOD FOR FORMING THE SAME AND SEMICONDUCTOR STRUCTURE COMPRISING THE SAME

(71) Applicant: Advanced Semiconductor Engineering, Inc., Kaohsiung (TW)

(72) Inventors: Hung-Hsien Huang, Kaohsiung (TW); Shin-Luh Tarng, Kaohsiung (TW); Ian Hu, Kaohsiung (TW); Chien-Neng Liao, Hsinchu (TW); Jui-Cheng Yu, Hsinchu (TW); Po-Cheng Huang, Tainan (TW)

(73) Assignee: ADVANCED SEMICONDUCTOR ENGINEERING, INC., Kaohsiung (TW)

( * ) Notice: Subject to any disclaimer, the term of this patent is extended or adjusted under 35 U.S.C. 154(b) by 21 days.

(21) Appl. No.: 17/163,217

(22) Filed: Jan. 29, 2021

(65) Prior Publication Data

US 2022/0243992 A1 Aug. 4, 2022

(51) Int. Cl.

| | |
|---|---|
| ***F28D 15/04*** | (2006.01) |
| ***F28D 15/02*** | (2006.01) |
| ***F28F 13/18*** | (2006.01) |

(52) U.S. Cl.

CPC ..... *F28D 15/046* (2013.01); *F28D 15/0233* (2013.01); *F28D 15/0283* (2013.01); *F28F 13/187* (2013.01); *F28F 2255/18* (2013.01)

(58) Field of Classification Search

CPC ..... F28D 15/046; F28D 15/0233; F28D 15/0283; F28F 13/187; F28F 2255/18

USPC ..... 165/104.21, 104.26

See application file for complete search history.

(56) References Cited

U.S. PATENT DOCUMENTS

| | | | | |
|---|---|---|---|---|
| 5,331,822 | A * | 7/1994 | Belliveau | A63J 5/025 62/384 |
| 6,323,432 | B1 * | 11/2001 | Campbell | H01L 23/3733 174/149 R |
| 6,397,935 | B1 * | 6/2002 | Yamamoto | F28D 15/0233 257/E23.098 |
| 6,474,074 | B2 * | 11/2002 | Ghoshal | H01L 23/427 165/104.21 |
| 6,997,245 | B2 * | 2/2006 | Lindemuth | F28D 15/046 165/104.21 |
| 7,246,655 | B2 * | 7/2007 | Mochizuki | F28D 15/046 165/104.21 |
| 8,482,921 | B2 * | 7/2013 | Cai | F28D 15/0283 165/80.4 |
| 10,136,557 | B2 * | 11/2018 | Kim | H05K 7/20336 |

(Continued)

FOREIGN PATENT DOCUMENTS

| | | | | |
|---|---|---|---|---|
| CN | 106435665 | A * | 2/2017 | C25D 3/38 |
| JP | 11287578 | A * | 10/1999 | |
| JP | 2001183079 | A * | 7/2001 | F28D 15/0233 |

*Primary Examiner* — Tho V Duong

(74) *Attorney, Agent, or Firm* — FOLEY & LARDNER LLP

(57) ABSTRACT

A heat transfer element, a method for manufacturing the same and a semiconductor structure including the same are provided. The heat transfer element includes a housing, a chamber, a dendritic layer and a working fluid. The chamber is defined by the housing. The dendritic layer is disposed on an inner surface of the housing. The working fluid is located within the chamber.

8 Claims, 24 Drawing Sheets

(56) References Cited

U.S. PATENT DOCUMENTS

| | | | | |
|---|---|---|---|---|
| 2003/0173064 | A1* | 9/2003 | Ueki | F28D 15/0233 29/890.032 |
| 2006/0098411 | A1* | 5/2006 | Lee | F28D 15/046 257/E23.088 |
| 2009/0040726 | A1* | 2/2009 | Hoffman | F28D 15/0233 29/890.032 |
| 2009/0194259 | A1* | 8/2009 | Meyer, IV | F28D 15/04 165/104.26 |
| 2010/0229394 | A1* | 9/2010 | Tsai | F28D 15/046 29/890.032 |
| 2015/0060021 | A1* | 3/2015 | Chauhan | F28D 15/046 29/890.032 |
| 2015/0327404 | A1 | 11/2015 | Wang et al. | |
| 2018/0010861 | A1* | 1/2018 | Wakaoka | H01L 23/427 |
| 2018/0017345 | A1* | 1/2018 | Poltorak | H05K 1/0203 |
| 2019/0067156 | A1* | 2/2019 | Kim | H01L 23/3675 |
| 2020/0221605 | A1* | 7/2020 | Vanderwees | B22F 3/11 |
| 2020/0355444 | A1* | 11/2020 | Chen | F28D 15/0283 |
| 2020/0400382 | A1* | 12/2020 | Cheng | F28D 15/0258 |

* cited by examiner

100

100

100

100

100

800

HEAT TRANSFER ELEMENT, METHOD FOR FORMING THE SAME AND SEMICONDUCTOR STRUCTURE COMPRISING THE SAME

BACKGROUND

1. Field of the Disclosure

The present disclosure relates to a heat transfer element, and particularly to a heat transfer element including a dendritic layer. The present disclosure also relates to a method for manufacturing the heat transfer element and a semiconductor structure including the heat transfer element.

2. Description of the Related Art

The semiconductor industry has seen growth in an integration density of a variety of electronic components in some semiconductor device packages. This increased integration density often corresponds to an increased power density in the semiconductor device packages. As the power density of semiconductor device packages grows, heat dissipation becomes an issue. Thus, it is desirable to have a heat transfer element having good heat dissipation efficiency.

SUMMARY

In some embodiments, a heat transfer element includes a housing, a chamber, a dendritic layer and a working fluid. The chamber is defined by the housing. The dendritic layer is disposed on an inner surface of the housing. The working fluid is located within the chamber.

In some embodiments, a semiconductor structure includes a heat transfer element. The heat transfer element includes a housing, a chamber, a dendritic layer and a working fluid. The chamber is defined by the housing. The dendritic layer is disposed on an inner surface of the housing. The working fluid is located within the chamber.

In some embodiments, a method for manufacturing a heat transfer element includes the following operations: providing a first portion and a second portion of a housing; forming a dendritic layer on one or more surfaces of the first portion and second portion; sealing the first portion with the second portion to form the housing, wherein the housing defines a chamber and the dendritic layer is within the chamber; and filling a working fluid into the chamber.

BRIEF DESCRIPTION OF THE DRAWINGS

Aspects of some embodiments of the present disclosure are readily understood from the following detailed description when read with the accompanying figures. It should be noted that various structures may not be drawn to scale, and dimensions of the various structures may be arbitrarily increased or reduced for clarity of discussion.

DETAILED DESCRIPTION

Figure 1A:
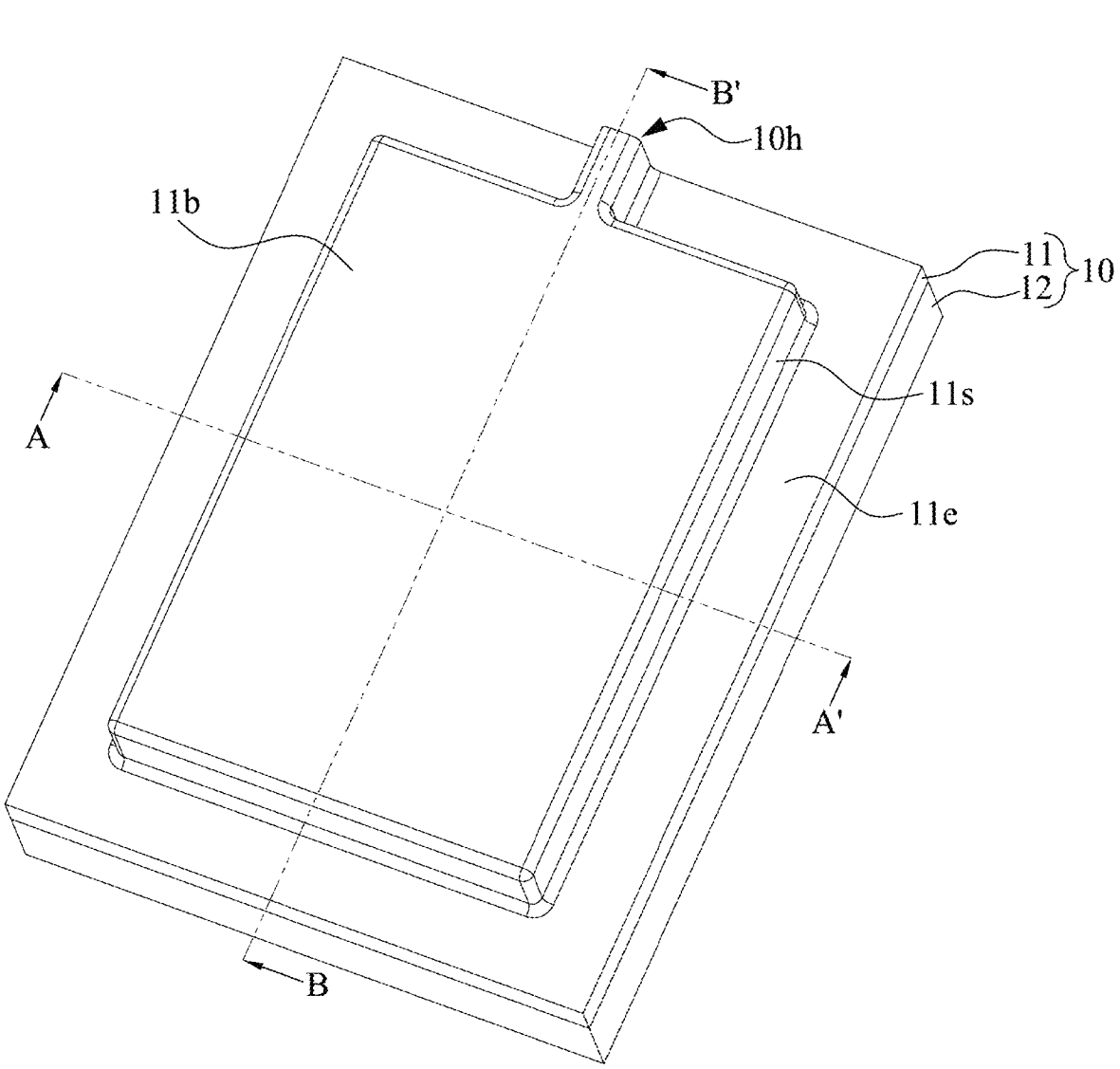
FIG. 1A illustrates a top view of an example of a heat transfer element according to some embodiments of the present disclosure.

Common reference numerals are used throughout the drawings and the detailed description to indicate the same or similar components. Embodiments of the present disclosure will be readily understood from the following detailed description taken in conjunction with the accompanying drawings.

The following disclosure provides for many different embodiments, or examples, for implementing different features of the provided subject matter. Specific examples of components and arrangements are described below to explain certain aspects of the present disclosure. These are, of course, merely examples and are not intended to be limiting. For example, the formation of a first feature over or on a second feature in the description that follows may include embodiments in which the first and second features are formed or disposed in direct contact, and may also include embodiments in which additional features may be formed or disposed between the first and second features, such that the first and second features may not be in direct contact. In addition, the present disclosure may repeat reference numerals and/or letters in the various examples. This repetition is for the purpose of simplicity and clarity and does not in itself dictate a relationship between the various embodiments and/or configurations discussed.

Figure 1B:
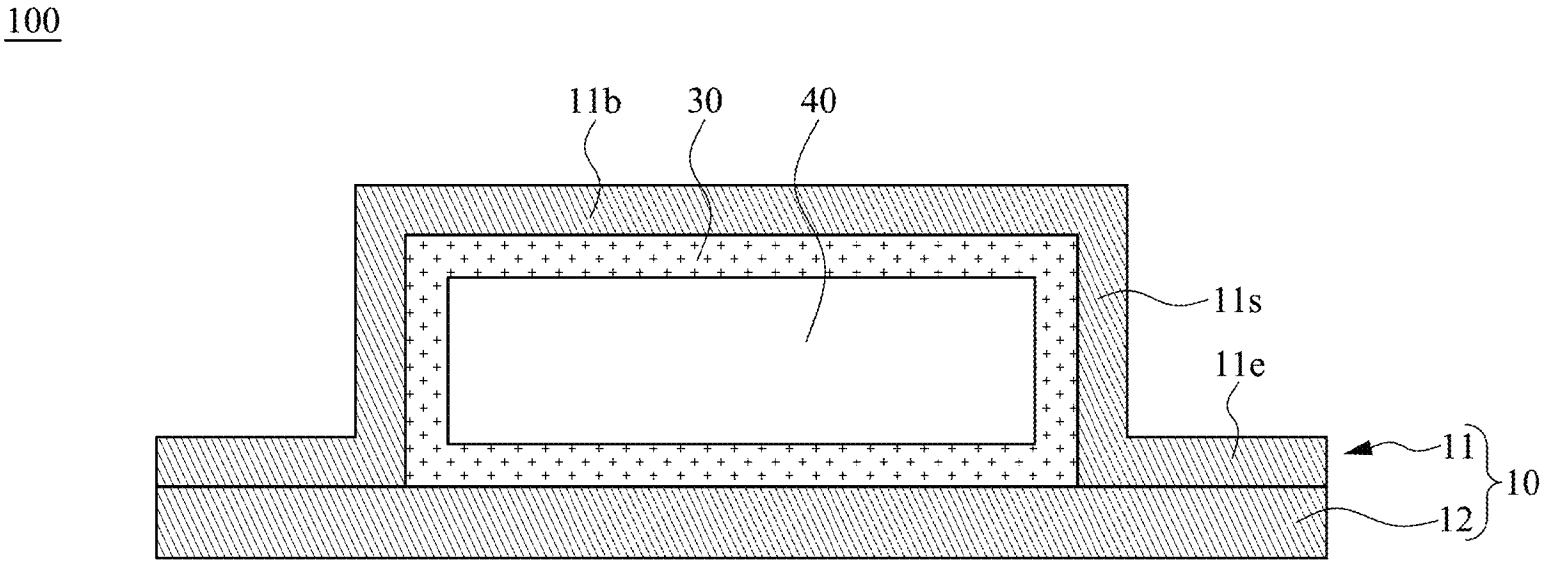
FIG. 1B illustrates a cross-sectional view of the heat transfer element along line A-A' of FIG. 1A.
Figure 1C:
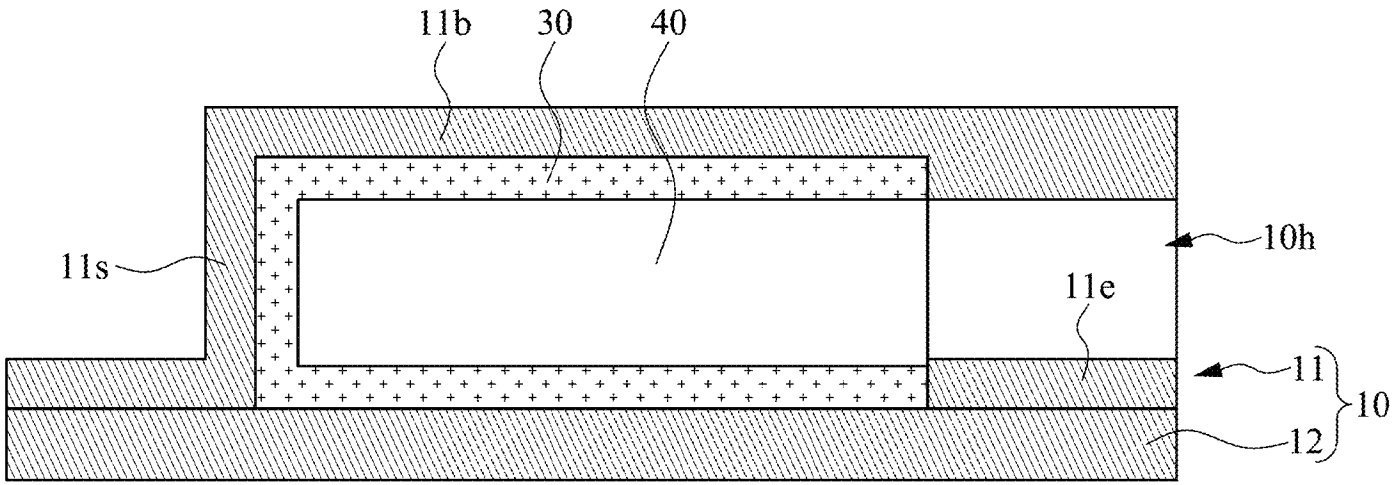
FIG. 1C illustrates a cross-sectional view of the heat transfer element along line B-B' of FIG. 1A.

FIG. 1A illustrates a top view of an example of a heat transfer element 100 according to some embodiments of the present disclosure; FIG. 1B illustrates a cross-sectional view of the heat transfer element 100 along line A-A' of FIG. 1A; FIG. 1C illustrates a cross-sectional view of the heat transfer element 100 along line B-B' of FIG. 1A. The heat transfer element 100 includes a housing 10, a chamber 40, a wick 30 and a working fluid (not shown). The wick is a dendritic layer.

In some embodiments, the heat transfer element 100 may be a vapor chamber. In some embodiments, the heat transfer element 100 may be a heat pipe or other heat transfer element(s).

The housing 10 may be formed of thermally-conductive material. In some embodiments, the housing 10 may include or be formed of metal, such as copper (Cu), aluminum (Al), titanium (Ti), nickel (Ni), gold (Au), silver (Ag), stainless steel or an alloy thereof; metal oxide, such as aluminum oxide or beryllium oxide; or other materials having high thermal conductivity. In some embodiments, the housing 10 may include or be formed of copper.

In some embodiments, the housing 10 may include a first portion 11 and a second portion 12. In some embodiments, the first portion 11 may be referred to as a top portion or an upper portion of the housing 10 and the second portion 12 may be referred to as a bottom portion or a lower portion of the housing 10. The first portion 11 is connected or bonded to the second portion 12. For example, edges of the first portion 11 and the second portion 12 can be sealed. The first portion 11 and the second portion 12 may have any suitable shape which can be sealed with each other and form the chamber 40 therebetween. In some embodiments, the second portion 12 may be flat. In some embodiments, the first portion 11 has a base 11*b*, a sidewall 11*s* and an extension 11*e*. An end of the sidewall 11*s* is connected to a periphery of the base 11*b* and the extension 11*e* is extended outwardly from the other end of the sidewall 11*s*. The extension 11*e* ("edge") of the first portion 11 is sealed with the periphery ("edge") of the second portion 12, and thus, the inner surfaces of the base 11*b*, the sidewall 11*s* and the second portion 12 (the inner surfaces of the housing) define the chamber 40.

Figure 2:
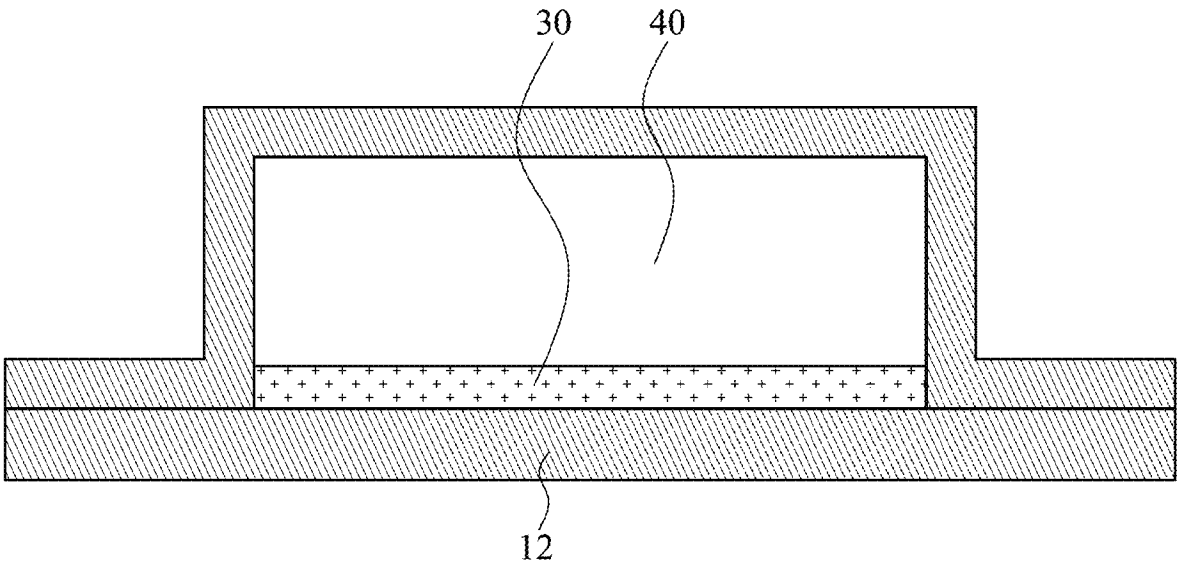
FIG. 2 illustrates a cross-sectional view of an example of a heat transfer element according to some embodiments of the present disclosure.

The dendritic layer 30 is disposed within the chamber 40. The dendritic layer 30 may be disposed on one or more inner surfaces of the housing 10. For example, in some embodiments as illustrated in FIG. 1B, the dendritic layer 30 is disposed on the inner surfaces of the base 11*b* and the sidewall 11*s* of the first portion 11 and the inner surface of the second portion 12. In some embodiments, the dendritic layer 30 may be disposed on the inner surfaces of the base 11*b* of the first portion 11 and the inner surface of the second portion 12 (or the top inner surface and the bottom inner surface of the housing 10). In some embodiments, for example, those illustrated in FIG. 2, the dendritic layer 30 may be disposed on the inner surface of the second portion 12 (or the bottom inner surface of the housing 10).

Figure 9A:
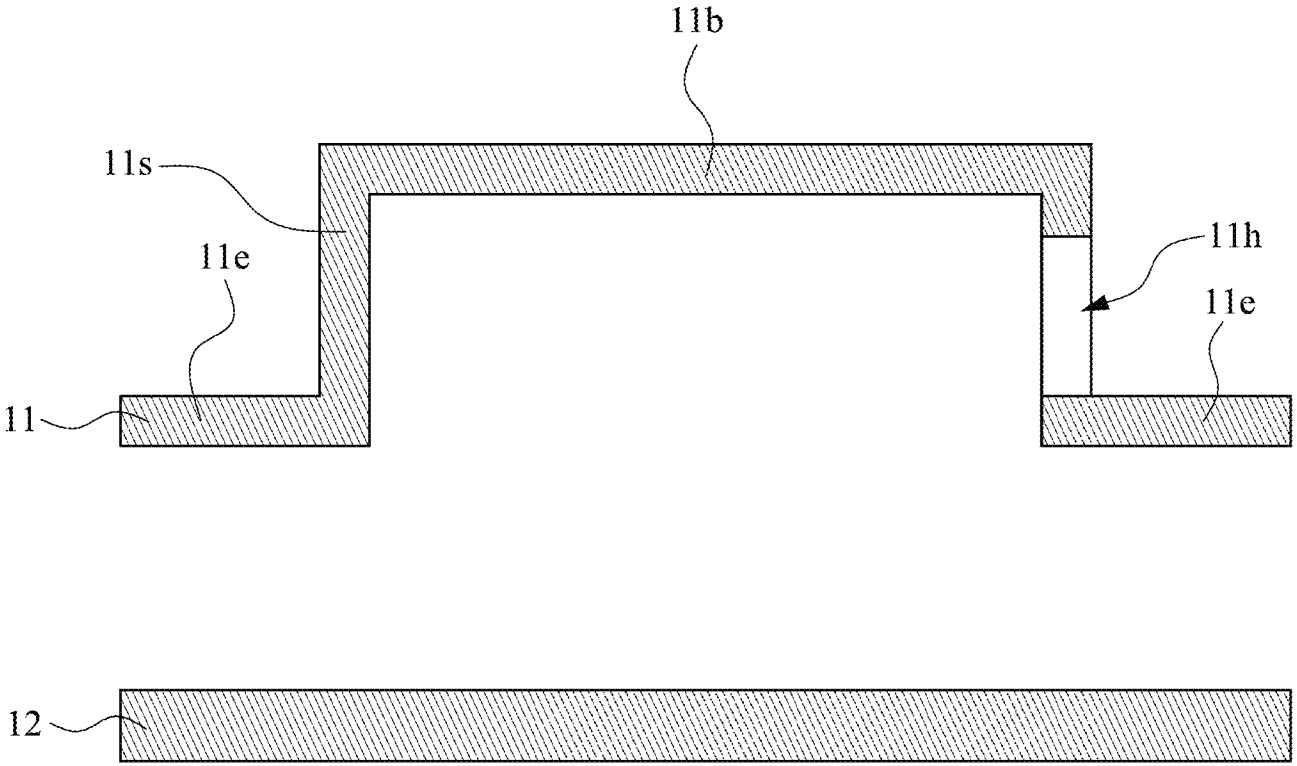
FIG. 9A, FIG. 9B, FIG. 9C, FIG. 9D, FIG. 9E, FIG. 9F, FIG. 9G, FIG. 9H and FIG. 9I illustrate various stages of an example of a method for manufacturing a heat transfer element according to some embodiments of the present disclosure.

Referring to FIG. 1C, the housing may include an opening 10*h*. In some embodiments, the opening 10*h* may be a hollow tube. For example, the first portion 11 may extend outwardly from the sidewall 11*s* of the first portion 11 and form the hollow tube. The bottom of the hollow tube may be defined by the extension 11*e* or the second portion 12. During the manufacturing process, the working fluid may be filled into the chamber through the opening 10*h* and then the opening 10*h* is sealed to avoid the leakage of the working fluid. In some embodiments, the opening 10*h* may be a penetration hole 11*h* formed in the sidewall 11*s* of the first portion 11 as illustrated in FIG. 9A.

Figure 3A:
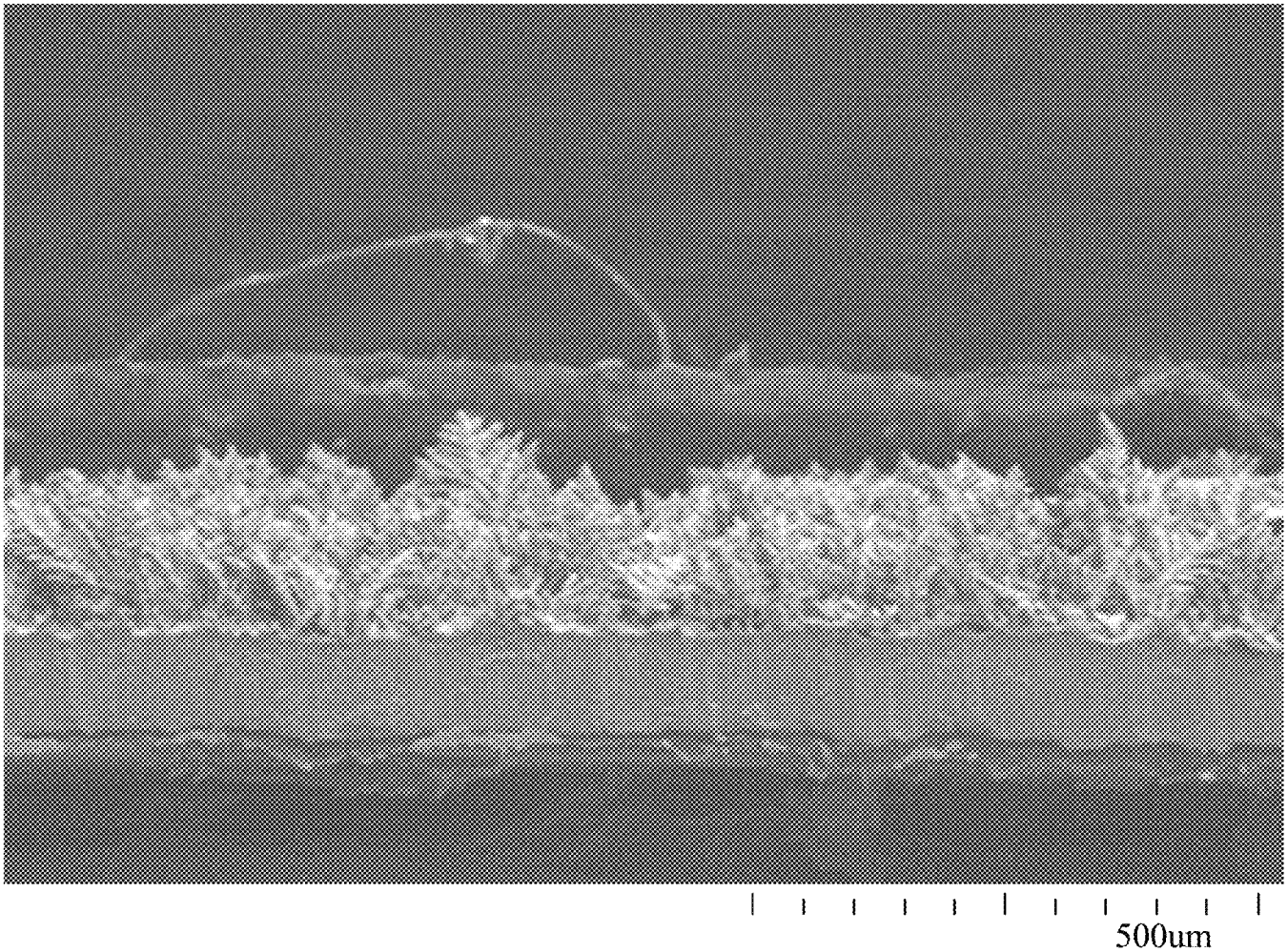
FIG. 3A is a scanning electron microscopic image of a cross-sectional view of an example of a dendritic layer according to some embodiments of the present disclosure.
Figure 3B:
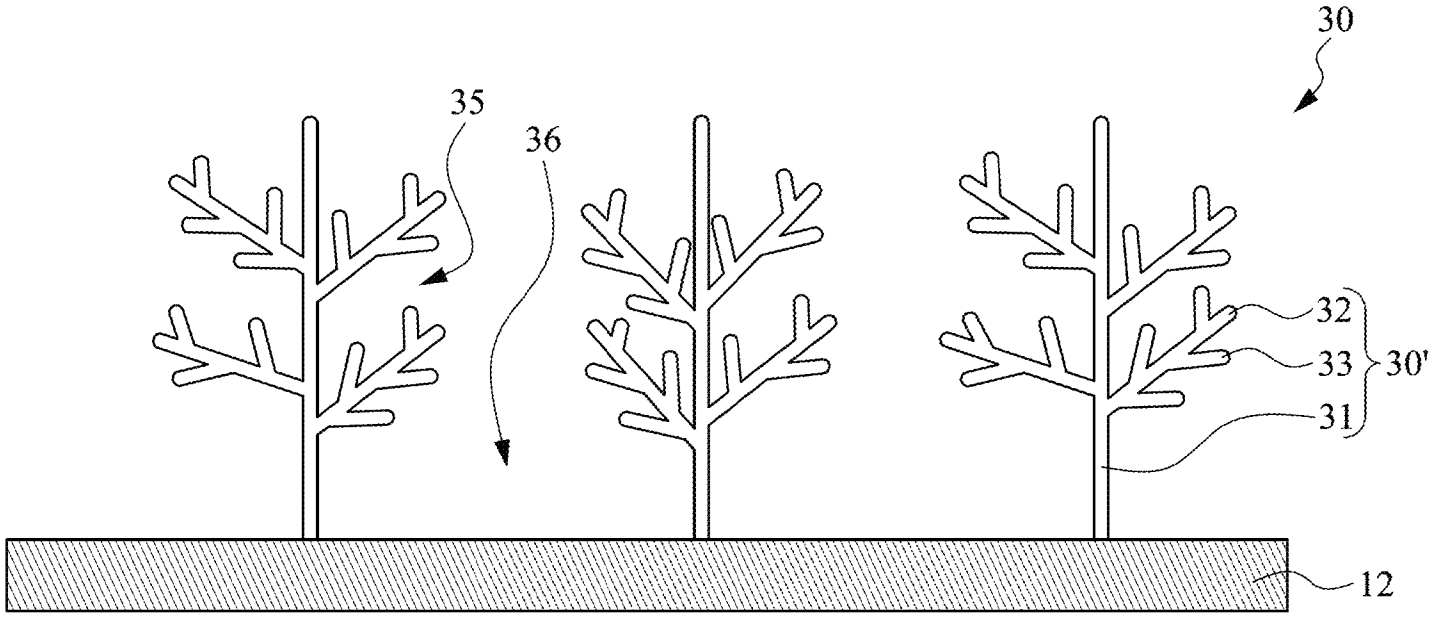
FIG. 3B is a schematic diagram of an example of a dendritic layer according to some embodiments of the present disclosure.

FIG. 3A is a scanning electron microscopic image of a cross-sectional view of the dendritic layer 30 according to some embodiments of the present disclosure. FIG. 3B is a schematic diagram of the dendritic layer 30 disposed on the inner surface of the housing 10 (e.g., the inner surface of the second portion 12).

As illustrated in FIG. 3B, the dendritic layer 30 are formed by a plurality of dendritic structures 30'. The dendritic structure 30' may include a main branch or trunk (i.e., primary dendrite arm) 31 and a plurality of side branches 32 (i.e., secondary dendrite arms) grown from the main branch 31. In some embodiments, the dendritic structure 30' may further include a plurality of side branches 33 (i.e., tertiary dendrite arms) grown from the side branches 32, and so on. A bottom of the main branch 31 is attached to the inner surface of the housing. The dendritic layer 30 includes intra-dendritic pores (or channels) 35 and inter-dendritic pores (or channels) 36. The intra-dendritic pores 35 are located within a dendritic structure 30' and defined by the main branch 31 and side branches 32 of the dendritic structure 30'. The inter-dendritic pores 36 are located between or among two or more dendritic structures 30'. In some embodiments, the inter-dendritic pores 36 may have a size greater than the intra-dendritic pores 35, and the dendritic layer 30 may be referred to as a dual-sized porous structure. The intra-dendritic pores 35 enhances capillary force within the dendritic layer 30 so that the condensed working fluid can be sucked by the dendritic layer 30 and flow within the dendritic layer 30 from a position at a lower temperature towards a position at a higher temperature. The inter-dendritic pores 36 provide fluid channels with a reduced flow resistance and thus are effective to accelerate the flow of the condensed working fluid. It has been found that the heat transfer element 100 according to the present disclosure has a comparable or even superior heat transfer efficiency (or heat dissipation efficiency) to the existing techniques.

In some embodiments, the dendritic layer 30 may have a thickness in the range of 100 μm to 600 μm (e.g., 100 μm, 120 μm, 130 μm, 150 μm, 170 μm, 180 μm, 200 μm, 250 μm, 300 μm, 350 μm, 400 μm, 450 μm, 500 μm, 550 μm, 560 μm, 580 μm or 600 μm). The thickness of the dendritic layer 30 relates to the length of the primary dendrite arms of the dendritic structures 30'. In some embodiments, the length of the primary dendrite arms of the dendritic structures 30' may be within the same range as the thickness of the dendritic layer 30. If the thickness is too thin, a dendritic structure cannot be formed. If the thickness is too great, the adhesion between the dendritic layer 30 and the inner surface of the housing may be deteriorated.

In some embodiments, a ratio of a length of the secondary dendrite arm to a length of the primary dendrite arm may be 1:10 to 5.5:10 (e.g., 1:10, 1.5:10, 2:10, 2.5:10, 3:10, 3.5:10, 4:10, 5.5:10, 5:10 or 5.5:10); in such embodiments, superior capillary ability can be achieved. In some embodiments, a spacing between two adjacent dendritic structures 30' may be in the range of 40 μm to 250 μm (e.g., 40 μm, 50 μm, 60 μm, 70 μm, 80 μm, 90 μm, 100 μm, 110 μm, 120 μm, 130 μm, 140 μm, 150 μm, 160 μm, 170 μm, 180 μm, 190 μm, 200 μm, 210 μm, 220 μm, 230 μm, 240 μm, or 250 μm).

The dendritic layer 30 may include or be formed of metal, such as Cu, Al, Ti, Ni, Ag, alloy, metal oxide or other suitable materials. In some embodiments, the material of the dendritic layer 30 may be the same as or similar to that of the housing 10. In some embodiments, the dendritic layer 30 and the housing 10 include or are formed of Cu. In some embodiments, the bottom of the dendritic layer 30 may be sintered or partially sintered, which enhances the adhesion between the dendritic layer 30 and the housing 10.

The working fluid is located within the chamber 40. The material of the working fluid is selected based on the temperature at which the heat transfer element may operate (e.g., the operating temperature). For example, the working fluid is selected from the materials that can undergo gas-liquid phase changes within the chamber 40 so that the chamber 40 includes both vapor and liquid within the operating temperature range. In some embodiments, the working fluid may include, for example, water or an organic solution, such as ammonia, alcohol (e.g., ethanol) or any other suitable materials.

In some embodiments, at least a portion of the working fluid absorbs heat and is vaporized into gas or vapor. The vaporized working fluid flows within the chamber 40 from a position at a higher temperature to a position at a lower temperature where the vaporized working fluid releases heat and is condensed into liquid. The condensed working fluid is then sucked by the dendritic layer 30 and flows within the dendritic layer 30 back to the position at a higher temperature to continue another thermal cycle.

Figure 4A:
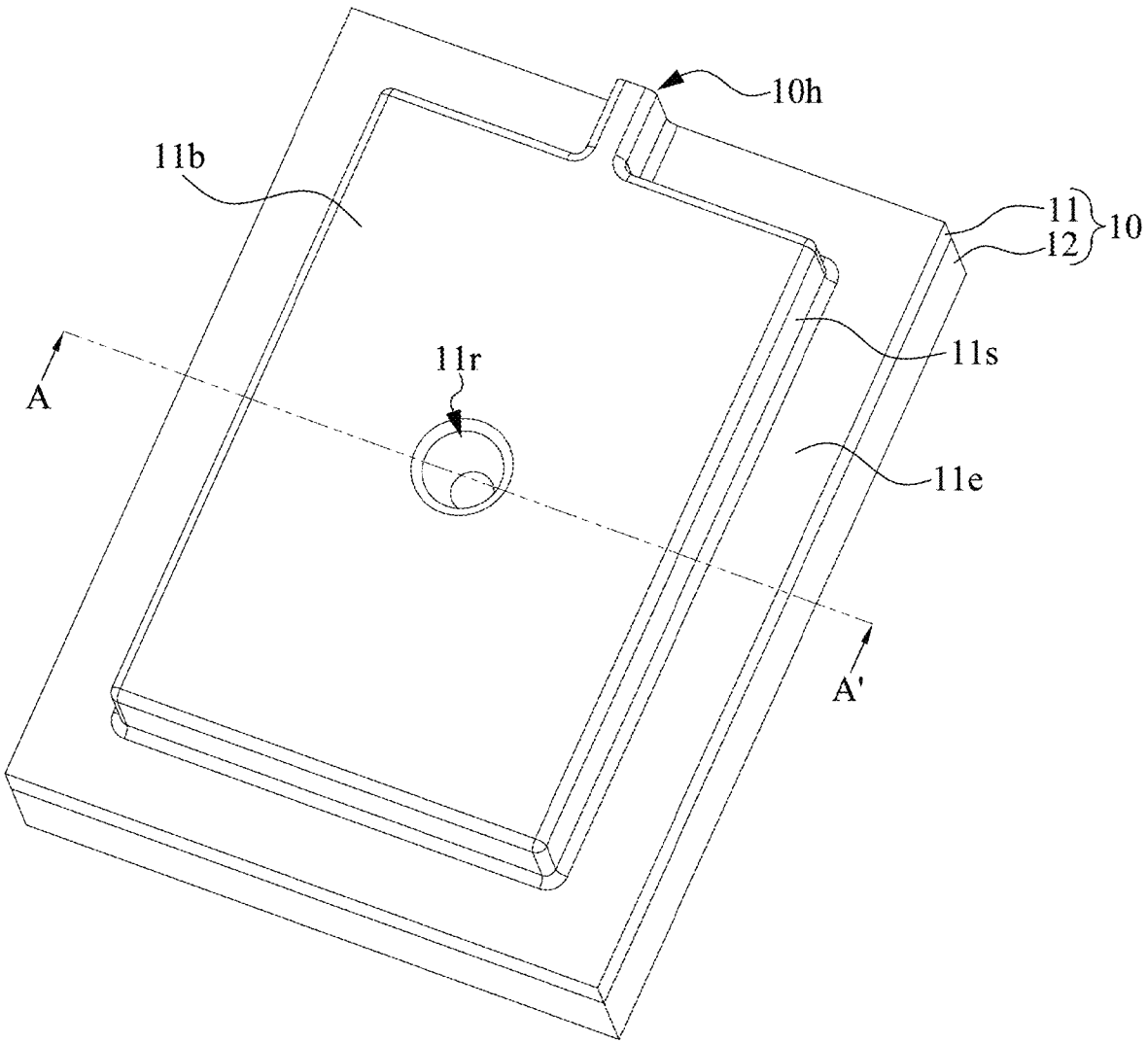
FIG. 4A illustrates a top view of an example of a heat transfer element according to some embodiments of the present disclosure.
Figure 4B:
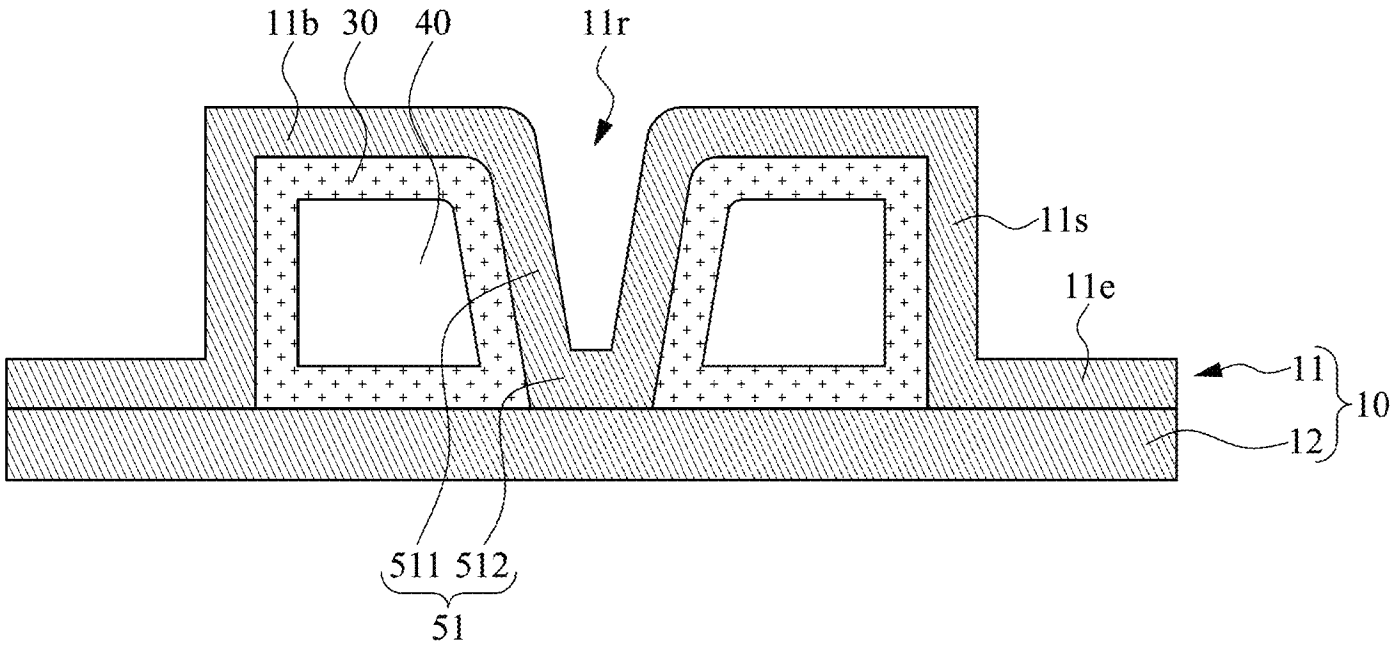
FIG. 4B illustrates a cross-sectional view of the heat transfer element along line A-A' of FIG. 4A.
Figure 5:
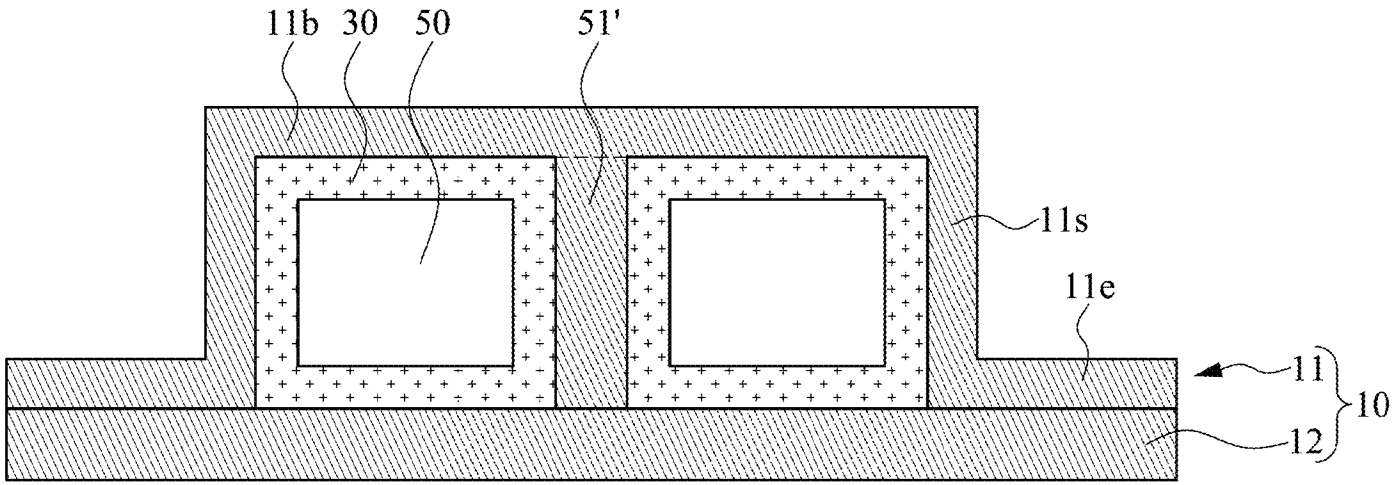
FIG. 5 illustrates a cross-sectional view of an example of a heat transfer element according to some embodiments of the present disclosure.

In some embodiments as illustrated in FIG. 4A, FIG. 4B and FIG. 5 and to be discussed below, the housing 10 may further include one or more reinforcement structures 51 or one or more 51' reinforcement structures connecting the first portion 11 and the second portion 12. The reinforcement structure 51 or 51' can enhance the mechanical strength of the housing 10.

FIG. 4A illustrates a top view of an example of a heat transfer element 100 according to some embodiments of the present disclosure; FIG. 4B illustrates a cross-sectional view of the heat transfer element 100 along line A-A' of FIG. 4A. In the embodiments illustrated in FIG. 4A and FIG. 4B, the reinforcement structure 51 includes a sidewall 511 and a bottom 512. The reinforcement structure 51 and the first portion 11 of the housing 10 can be formed as one-piece, for example, at least a portion of the base 11*b* is recessed toward the second portion 12 and contacts the second portion 12. The recessed portion forms the reinforcement structure 51. In other words, the sidewall 511 and the bottom 512 of the reinforcement structure 51 define a recess 11*r* of the first portion 11. As illustrated in FIG. 4B, the reinforcement structure 51 penetrates the chamber 40. In some embodiments, the dendritic layer 30 is disposed on an inner surface of the reinforcement structure 51.

FIG. 5 illustrates a cross-sectional view of the heat transfer element 100 according to some embodiments of the present disclosure. The structure of the heat transfer element 100 illustrated in FIG. 5 is similar to that illustrated in FIG. 4B except that the first portion 11 does not include a recess 11*r* and the reinforcement structure 51 is replaced by a reinforcement structure 51'. As illustrated in FIG. 5, one end of the reinforcement structure 51' connects the base 11*b* of the first portion 11 and the other end of the reinforcement structure 51' connects the second portion 12. The reinforcement structure 51' penetrates the chamber 40. In some embodiments, the dendritic layer 30 is disposed an inner surface of the reinforcement structure 51'. In some embodiments, the reinforcement structure 51' and the first portion 11 of the housing 10 can be formed as one-piece, for example, by stamping, or etching. In some embodiments, the reinforcement structure 51' may be bonded to the inner surface of the base 11*b* after the formation of the first portion 11.

FIG. 6A, FIG. 6B, FIG. 6C and FIG. 6D illustrate the structure of the wick formed on within a heat transfer element (e.g., on an inner surface of the second portion 12 of the housing) in some comparative embodiments. FIG. 6A, FIG. 6B, FIG. 6C and FIG. 6D illustrate a grooved wick structure 61, a wick structure 62 with sintered particles, a composite wick structure 63, and a mesh wick structure 64, respectively. As the need for smaller semiconductor devices grows, it is desirable to minimize the size of the heat transfer element while maintaining or even enhancing its heat transfer efficiency (or heat dissipation efficiency). However, it is difficult to satisfy such needs with the above wick structures.

Figure 6A:
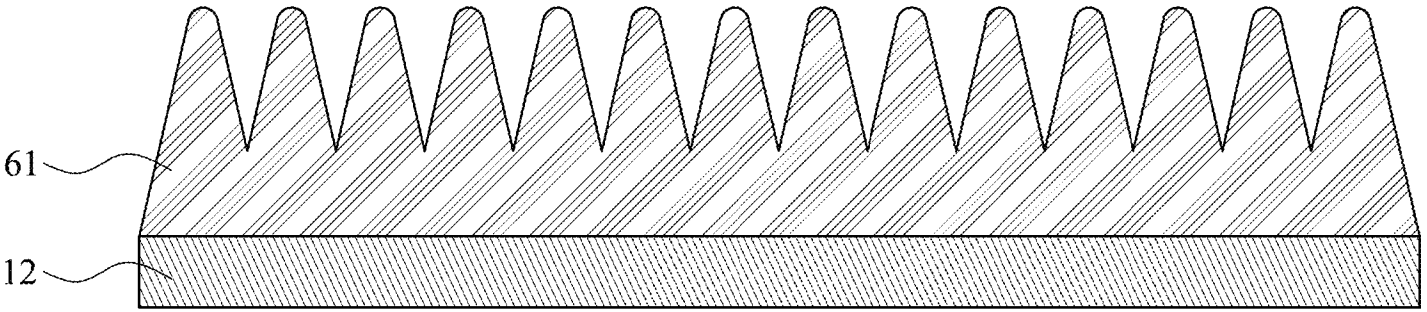
FIG. 6A, FIG. 6B and FIG. 6C illustrate cross-sectional views of the wick structure according to some comparative embodiments.
Figure 6B:
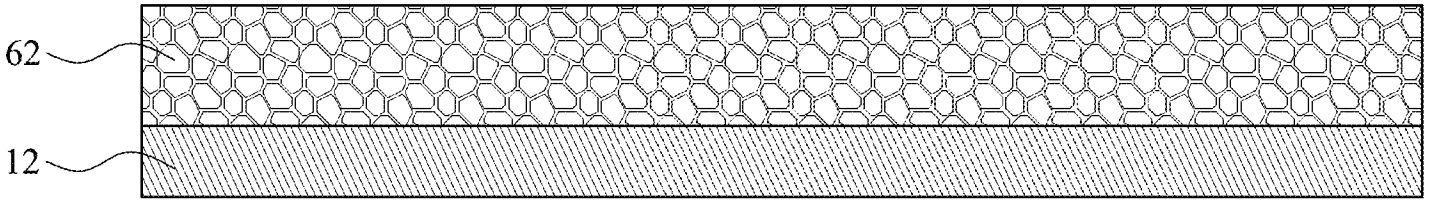
Figure 6C:
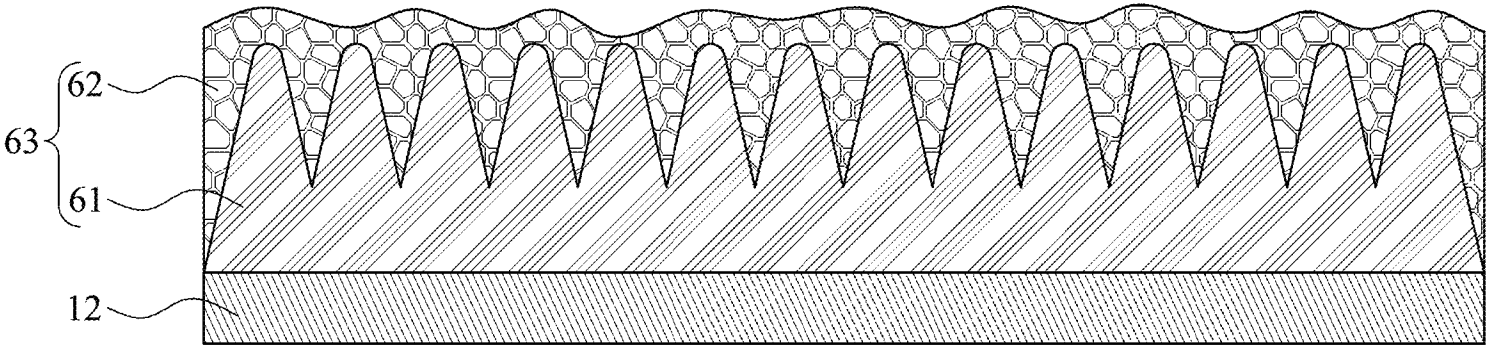
Figure 6D:
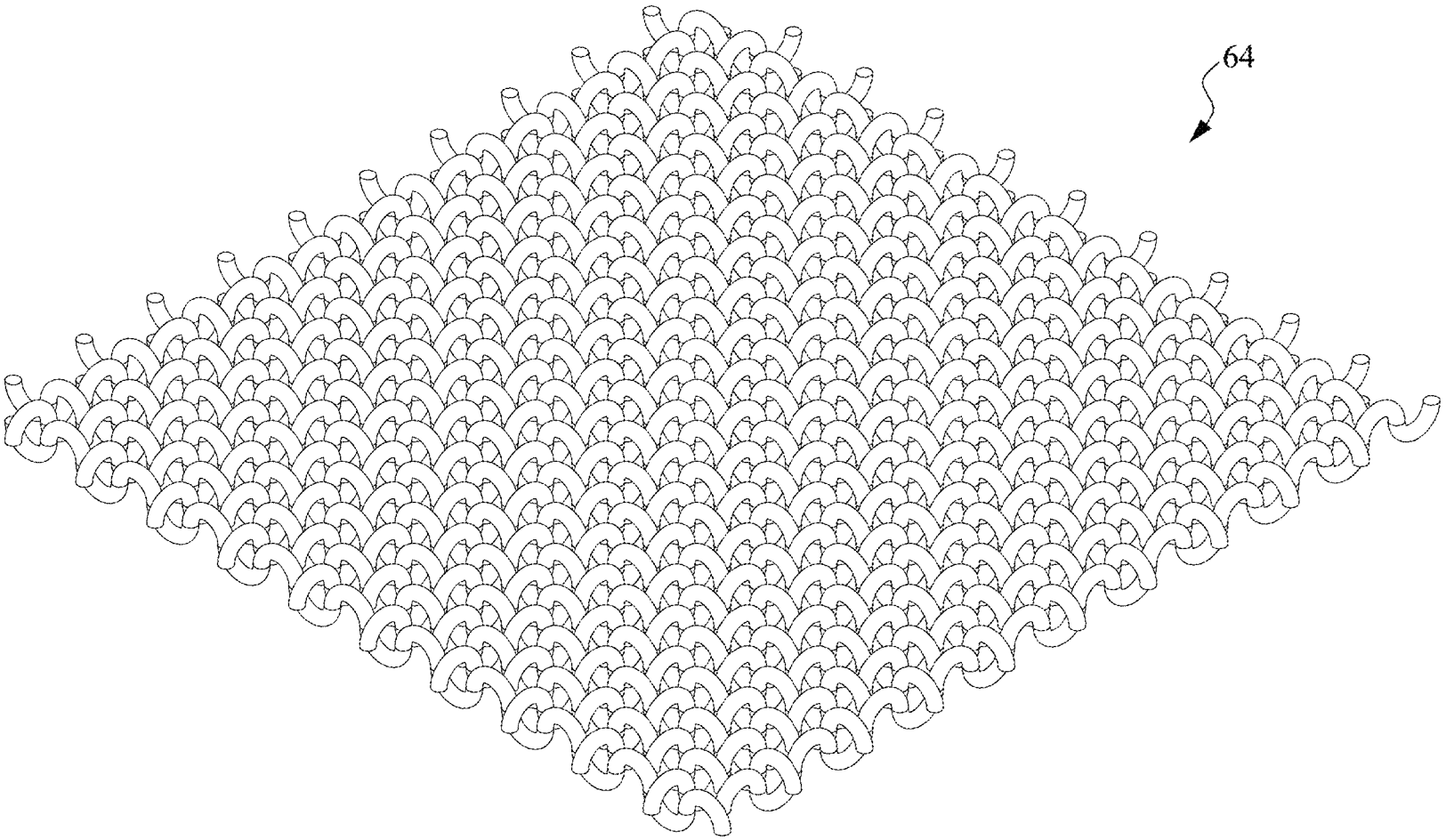
FIG. 6D is a schematic diagram of the mesh wick structure according to some comparative embodiments.

In the grooved wick structure 61 of FIG. 6A, the capillary ability is relatively low, the flow of working fluid is liable to be affected by gravity, and therefore, the working fluid cannot be effectively transported. In addition, the collapse of the tips of the grooved wick structure 61 becomes severer when the size of the grooved wick structure 61 reduces. In the wick structure 62 with sintered particles of FIG. 6B, the sintered particles provide a fine porous structure which improves the capillary ability but lowers permeability of working fluid. The sintering process to prepare the wick structure 62 is carried out at a high temperature for a long period of time. The manufacture cost of the wick structure 62 is higher and it is difficult to minimize the size thereof. In the composite wick structure 63 of FIG. 6C, a grooved wick structure 61 is first formed on an inner surface of the second portion 12 and a wick structure 62 with sintered particles is formed on the grooved wick structure 61. The composite wick structure 63 improves the capillary ability (as compared to the grooved wick structure 61) and the permeability of working fluid (as compared to the wick structure 62 with sintered particles). However, the manufacture cost of the composite wick structure 63 is much higher. In addition, when the size of the wick structure 63 reduces, it becomes difficult to sufficiently fill the particles into the grooved wick structure 61. The mesh wick structure 64 of FIG. 6D is individually formed and then attached to the inner surface of the second portion 12, which not only increases the complexity of the manufacture process but makes it difficult to reduce the size of the mesh wick structure 64. In addition, the mesh structure makes it difficult for the mesh wick structure 64 to well contact the inner surface of the second portion 12, which deteriorates the adhesion and the thermal conductivity of the resulting structure.

As compared to the embodiments illustrated in FIG. 6A, FIG. 6B, FIG. 6C and FIG. 6D, the heat transfer element according to the present disclosure includes a dendritic layer as the wick structure. The dendritic layer can be directly formed on the inner surface of the housing by electroplating. The manufacture process of the heat transfer element according to the present disclosure is relatively simple, cost-effective and time-effective, and can be easily integrated with other operations or manufacturing process of a semiconductor device or package. The thickness of the dendritic layer and the density of the dendritic structures can be controlled, for example, by adjusting the conditions of the electroplating process (e.g., the concentration of the plating solution, the applied current density, the operation time, etc.). The resulting dendritic layer provides good capillary ability and good permeability of working fluid, which facilitates the transportation of the working fluid and increases heat transfer efficiency. In some embodiments, the heat transfer element according to the present disclosure exhibits a capillary ability four times better than the heat transfer element having a wick structure 62. In addition, the size of the heat transfer element according to the present disclosure can be adjusted or reduced as needed. Thus, the purpose of miniaturization can be fulfilled. In some embodiments, the heat transfer element according to the present disclosure may have a thickness in the range of 0.2 mm to 5 mm (0.2 mm, 0.4 mm, 0.6 mm, 0.8 mm, 1 mm, 1.2 mm, 1.4 mm, 1.6 mm, 1.8 mm or 2 mm).

Figure 7:
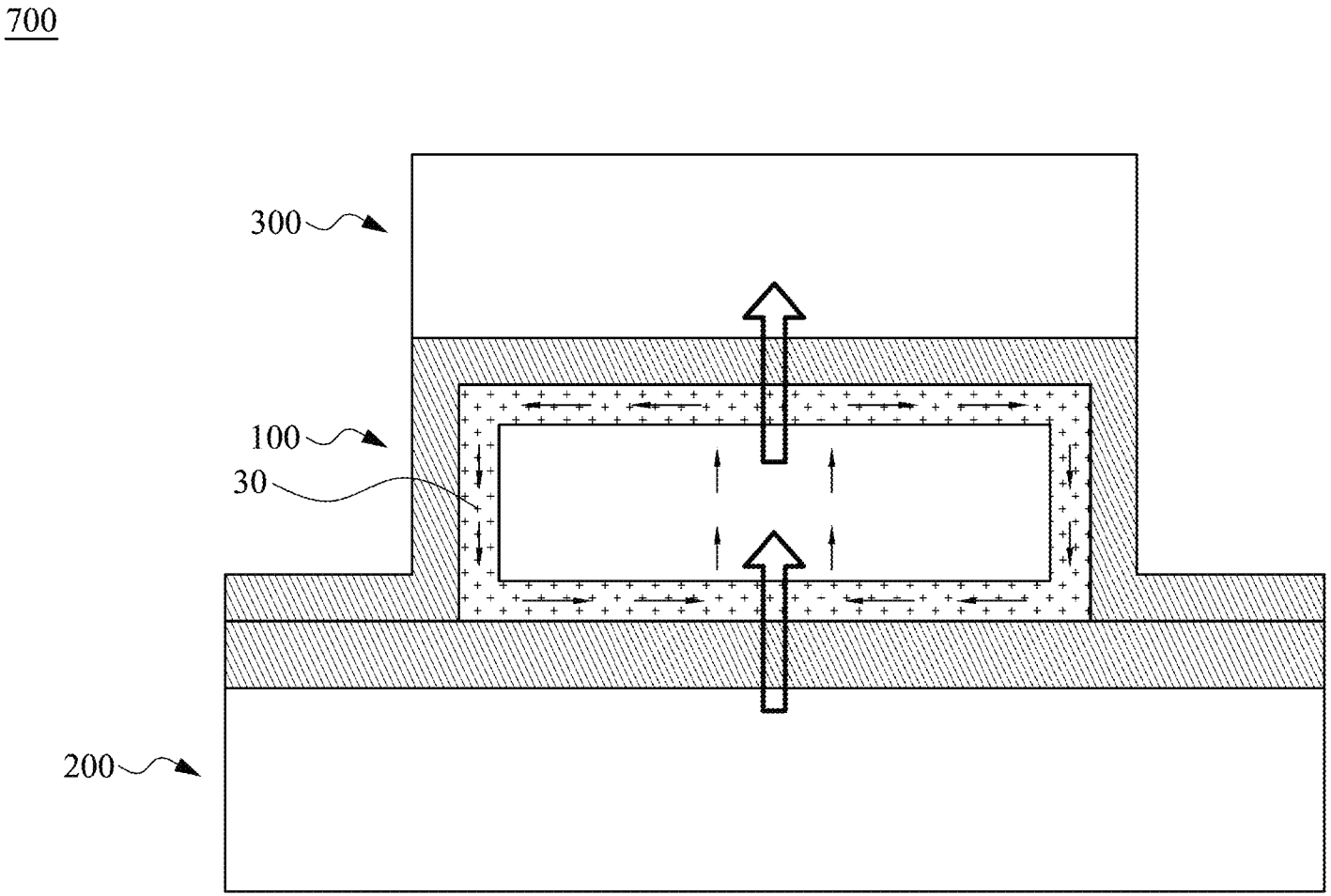
FIG. 7 illustrates a cross-sectional view of an example of a semiconductor structure according to some embodiments of the present disclosure.

FIG. 7 illustrates a cross-sectional view of the semiconductor structure 700 according to some embodiments of the present disclosure. The semiconductor structure 700 includes a substrate 200, a heat transfer element 100 and a heat sink 300. The heat transfer element 100 is disposed over the substrate 200 and the heat sink 300 is disposed over the heat transfer element 100. In some embodiments, the heat transfer element 100 contacts the substrate 200 and the heat sink 300. In some embodiments, the substrate 200 may be an electronic component (such as dies). In some embodiments, the substrate 200 may be a package substrate. The package substrate may include one or more electronic components and one or more circuit layers. The electronic component may be electrically connected to an external electronic device, a printed circuit board, etc., via the circuit layers. In some embodiments, the electronic component may be surrounded by an encapsulant. In some embodiments, the heat transfer element 100 may contact a top surface of the electronic components. In some other embodiments, the heat transfer element 100 may contact a top surface of the encapsulant. The working fluid at a bottom of the heat transfer element 100 absorbs the heat generated from the substrate 200 (e.g., the electronic components of the substrate 200) and vaporized. The vaporized working fluid flows towards the heat sink 300, releases heat to the heat sink 300 and condenses into liquid phase at a top of the heat transfer element 100. The condensed working fluid is sucked by the dendritic layer 30, flows along the dendritic layer 30, and back to the bottom of the heat transfer element 100 to continue another thermal cycle.

Figure 8:
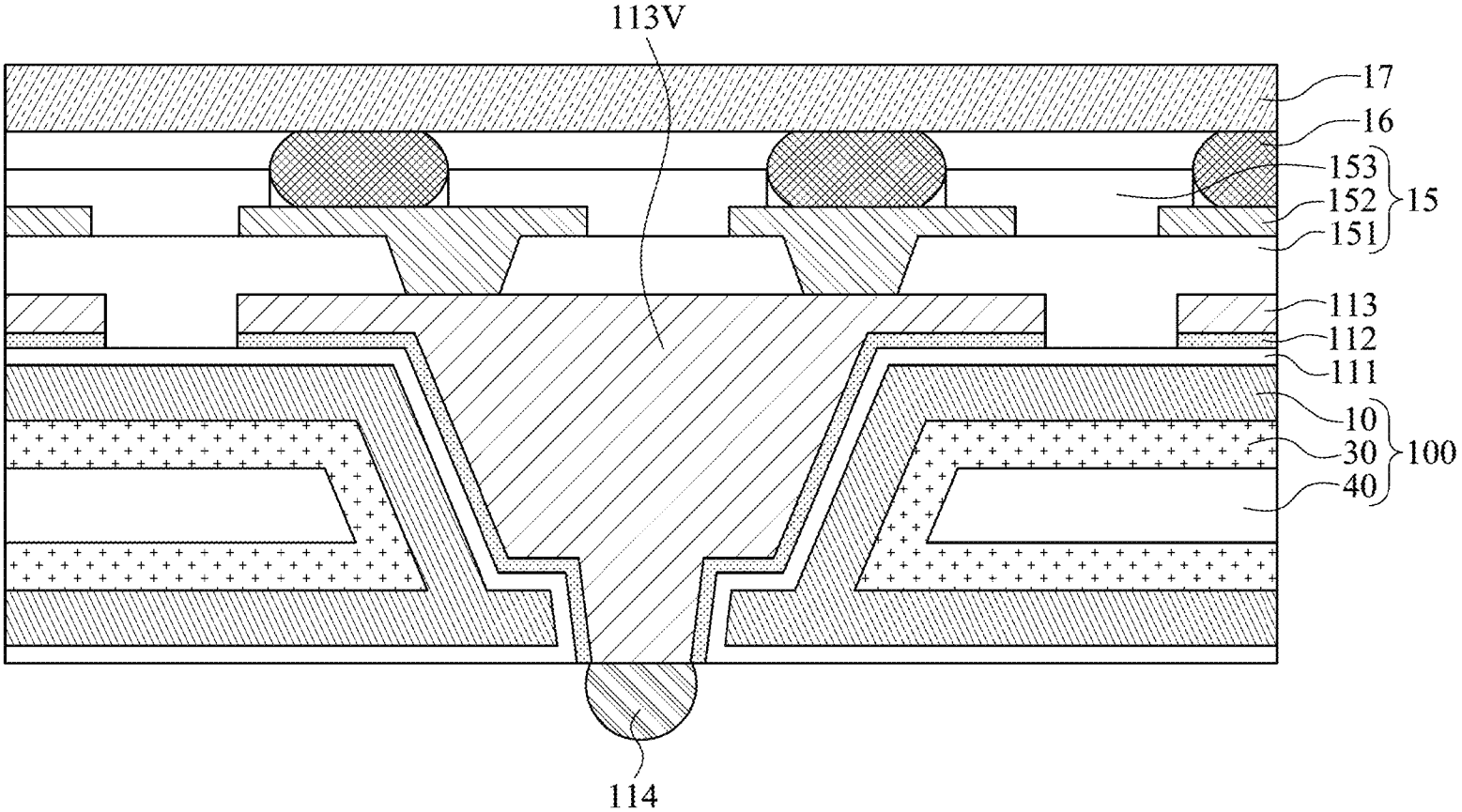
FIG. 8 illustrates a cross-sectional view of an example of a semiconductor structure according to some embodiments of the present disclosure.

FIG. 8 illustrates a cross-sectional view of the semiconductor structure 800 according to some embodiments of the present disclosure. The semiconductor structure 800 may include a heat transfer element 100, an electronic component 17 disposed over the heat transfer element, and a conductive via 113V penetrating the heat transfer element. The conductive via 113V is electrically isolated from the heat transfer element. It should be noted that for simplification, FIG. 8 only illustrates a portion of the cross-sectional view of the semiconductor structure 800. The semiconductor structure 800 may include a plurality of conductive vias 113V penetrating the heat transfer element 100.

In some embodiments, the semiconductor structure 800 may include a heat transfer element 100, an insulation layer 111, a conductive layer 113 and a redistribution layer 15.

The heat transfer element 100 may include a housing 10, a chamber 40 defined by the housing 10 and a dendritic layer 30 disposed within the chamber. The working fluid (not shown) is located within the chamber. The heat transfer element 100 may include an opening 113V penetrating from an upper surface of the heat transfer element 100 to the lower surface of the heat transfer element 100.

The insulation layer 111 is made of electrically-insulating material. The insulation layer 111 may be disposed on the upper surface, sidewall (e.g., sidewall which defines the opening 113V) and lower surface of the heat transfer element 100. In some embodiments, the insulation layer 111 is disposed between the heat transfer element 100 and the conductive layer 113. The insulation layer 111 may include oxide, nitride, polymer or other suitable materials. In some embodiments, the insulation layer 111 is electrically insulating but thermally conductive.

In some embodiments, a seed layer 112 may be disposed on the insulation layer 111 so as to facilitate the formation of the conductive layer 113. The seed layer 112 may be viewed as a portion of the conductive layer 113. The seed layer 112 may include metal, such as Cu, Al, Ti, Ni or Ag, alloy, or other suitable materials. The conductive layer 113 may include traces, conductive vias and pads. In some embodiments, the conductive layer 113 may be disposed on the seed layer 112. In some embodiments, the conductive layer 113 may include a conductive via filling the opening 113V. In some embodiments, the conductive via penetrates the heat transfer element 100, e.g., by passing through the opening 113V. The conductive layer 113 may include metal, such as Cu, Al, Ti, Ni or Ag, alloy or other suitable materials.

The redistribution layer 15 may be disposed on the upper surface of the heat transfer element 100. The redistribution layer 15 may include one or more dielectric layer (e.g., 151, 153) and one or more conductive layer (e.g., 152) to provide electrical interconnection. The dielectric layer 151 may cover a portion of the conductive layer 113 and fill the openings defined by the conductive layer 113. The conductive layer 152 is disposed on the dielectric layer 151 and may be electrically connected to the conductive layer 113. The dielectric layer 153 may cover a portion of the conductive layer 152. The dielectric layer 153 may be patterned so that a portion of the conductive layer 152 may be exposed from the dielectric layer 153.

In some embodiments as illustrated in FIG. 8, the semiconductor structure 800 may include one or more conductive element 114 disposed on the lower surface of the heat transfer element 100. The conductive element 114 may be electrically connected to the conductive via of the conductive layer 113. The conductive element 114 may include, for example, a solder ball. In some other embodiments, the semiconductor structure 800 may include another redistribution layer disposed on the lower surface of the heat transfer element 100.

The electronic component 17 (e.g., dies) may be disposed on the redistribution layer 15 and electrically connected to the redistribution layer 15 through the bumps or balls 16. The electronic component may be electrically connected to the conductive element 114 (or the redistribution layer) disposed on the lower surface of the heat transfer element 100 through the redistribution layer 15 and the conductive via of the conductive layer 113.

In the semiconductor structure 800 as illustrated in FIG. 8, the heat transfer element 100 serves as a substrate on which electrical circuits and electronic components can be disposed while assisting in dissipating heat generated from the electronic components or the electrical circuits at the same time. Therefore, heat generated from the electronic components can be quickly released to the external environment. The semiconductor structure 800 according to the present disclosure integrates the functions of heat dissipation and electrical interconnection within a heat transfer element 100; therefore, as compared to the comparative embodiments where an additional substrate is used, the semiconductor structure according to the present disclosure exhibits a superior heat dissipation ability while maintaining a sufficient amount of pathways for transporting electrical signals. Further, the semiconductor structure according to the present disclosure has a relatively small size as compared to the comparative embodiments.

FIG. 9A, FIG. 9B, FIG. 9C, FIG. 9D, FIG. 9E, FIG. 9F, FIG. 9G, FIG. 9H and FIG. 9I illustrate various stages of an example of a method for manufacturing a heat transfer element according to some embodiments of the present disclosure.

Referring to FIG. 9A, a top portion 11 and a bottom portion 12 of the housing are provided. The top portion 11 of the housing has a base 11*b*, a sidewall 11*s* and an extension 11*e*. A hole 11*h* penetrating the sidewall 11*s* of the top portion 11 is formed. The top portion 11 and the bottom portion 12 of the housing can be made of copper and may be formed, for example, by stamping.

In some embodiments, cleaning operations may carry out to clean the surfaces of the top portion 11 and the bottom portion 12. The cleaning operations may include immersing the top portion 11 and the bottom portion 12 in a cleaning solution (e.g., acetone) for ultrasonic vibrating; then immersing the top portion 11 and the bottom portion 12 in a further cleaning solution (e.g., 1M citric acid solution); and rinsing the top portion 11 and the bottom portion 12 by deionized water.

Figure 9B:
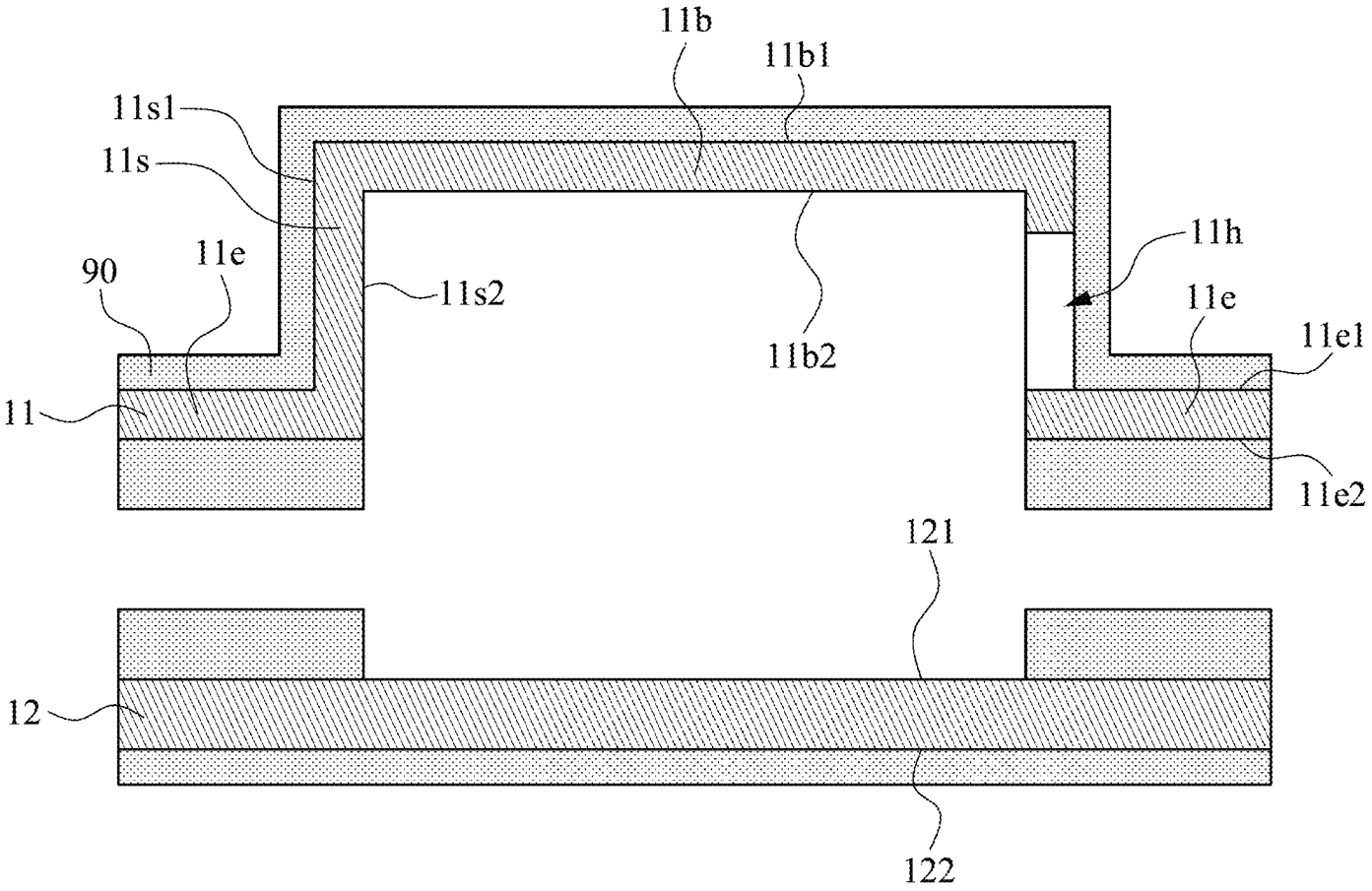

Referring to FIG. 9B, a blocking material 90 is attached to the top portion 11 and the bottom portion 12. The blocking material 90covers the top portion 11 and the bottom portion 12 except for the surfaces where the dendritic layer 30 needs to be formed. For example, in the embodiments shown in FIG. 9B, the outer surfaces (11*e*1, 11*b*1, 11*s*1) of the first portion 11, the surface 11*e*2 of the first portion 11, the surface 122 of the second portion 12 and the edges of the surface 121 of the second portion 12 are covered by the blocking material. The blocking material 90 can be made of any suitable material which is effective to prevent from the formation of an electroplated product thereon. The electroplated product is a reaction product of an electroplating process and may be referred to as "electroplated deposit." In some embodiments, the blocking material may be an adhesive, a photoresist or a mask.

Figure 9C:
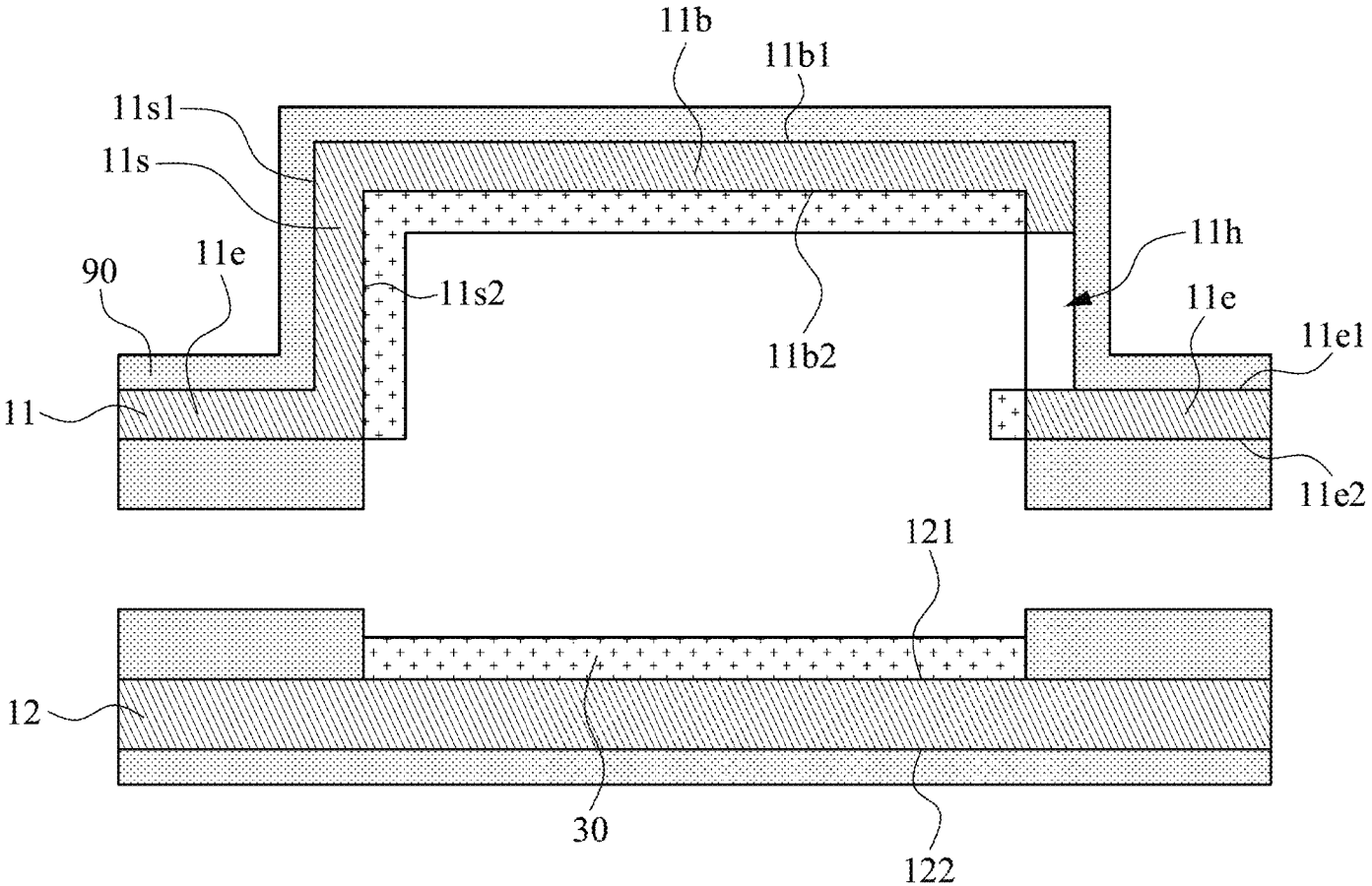

Referring to FIG. 9C, a dendritic layer 30 is formed on the uncovered surfaces of the top portion 11 and the bottom portion 12 by electroplating. In some embodiments, the electroplating solution may include copper sulfate and sulfuric acid (e.g., a mixture containing 0.4 M copper sulfate and 1.5 M sulfuric acid). The electroplating may be carried out under a constant current. In some embodiments, the current density may be in the range of 0.3 $A/cm^2$ to 1.5 $A/cm^2$. The time for electroplating may be around dozens of seconds to several minutes (e.g., from 60 seconds to 2 minutes or more). The current density and duration of electroplating can be adjusted so that the dendritic structures of the dendritic layer can be formed.

After the formation of the dendritic structures, a sintering operation is carried out at an elevated temperature so that the bottom of the dendritic structures may be sintered or partially sintered, which strengthens the adhesion between the dendritic structures and the surfaces where they are formed. In some embodiments, the sintering operation may be carried out at an oven under an inert gas/atmosphere or under vacuum. In some embodiments, the temperature for sintering may be in the range of 480° C. to 700° C. and the time for sintering may be around dozens of minutes to several hours (e.g., 1~2 hours or more).

Figure 9D:
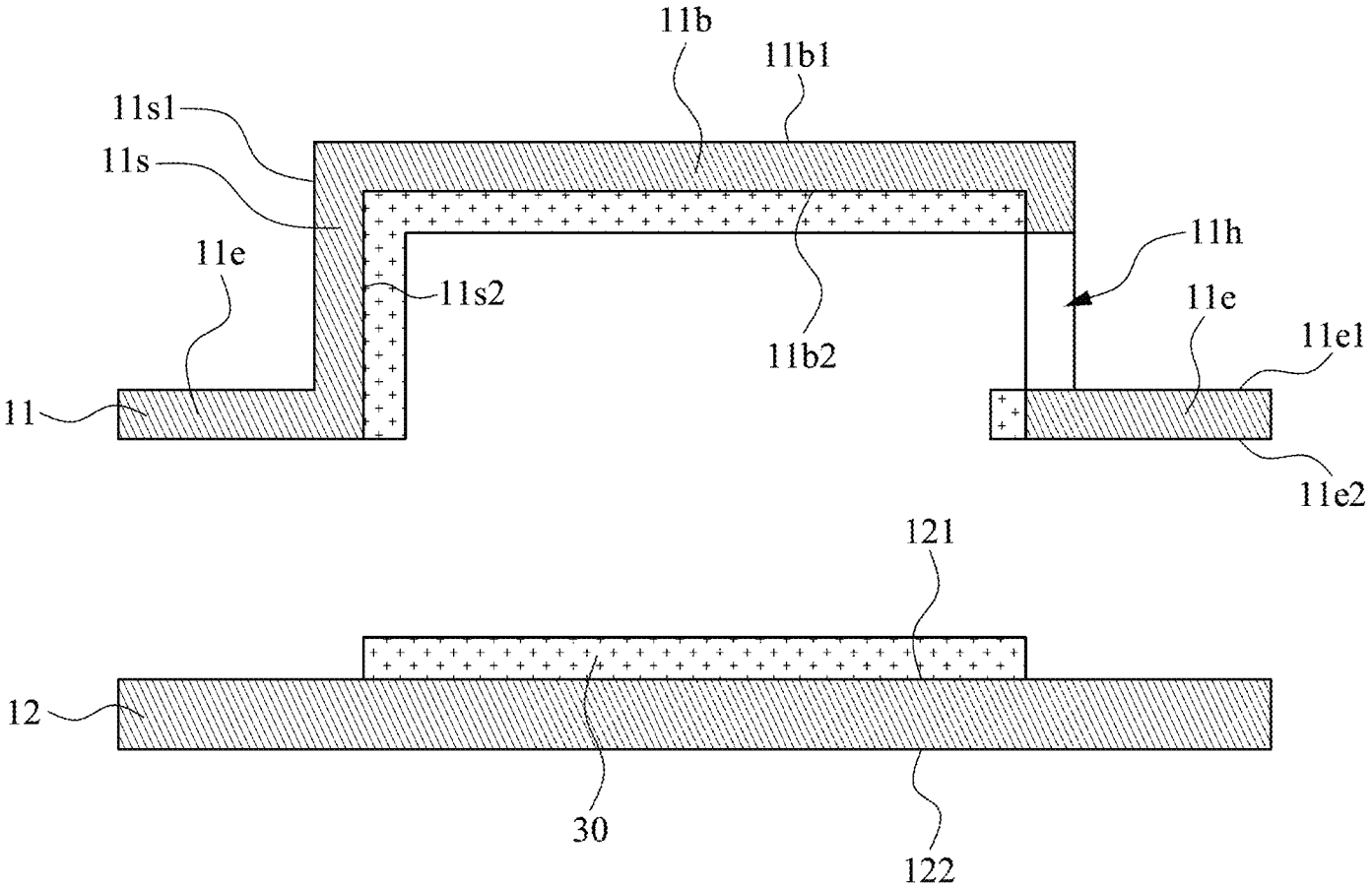

Referring to FIG. 9D, after the electroplating and sintering operations, the blocking material is removed.

Figure 9E:
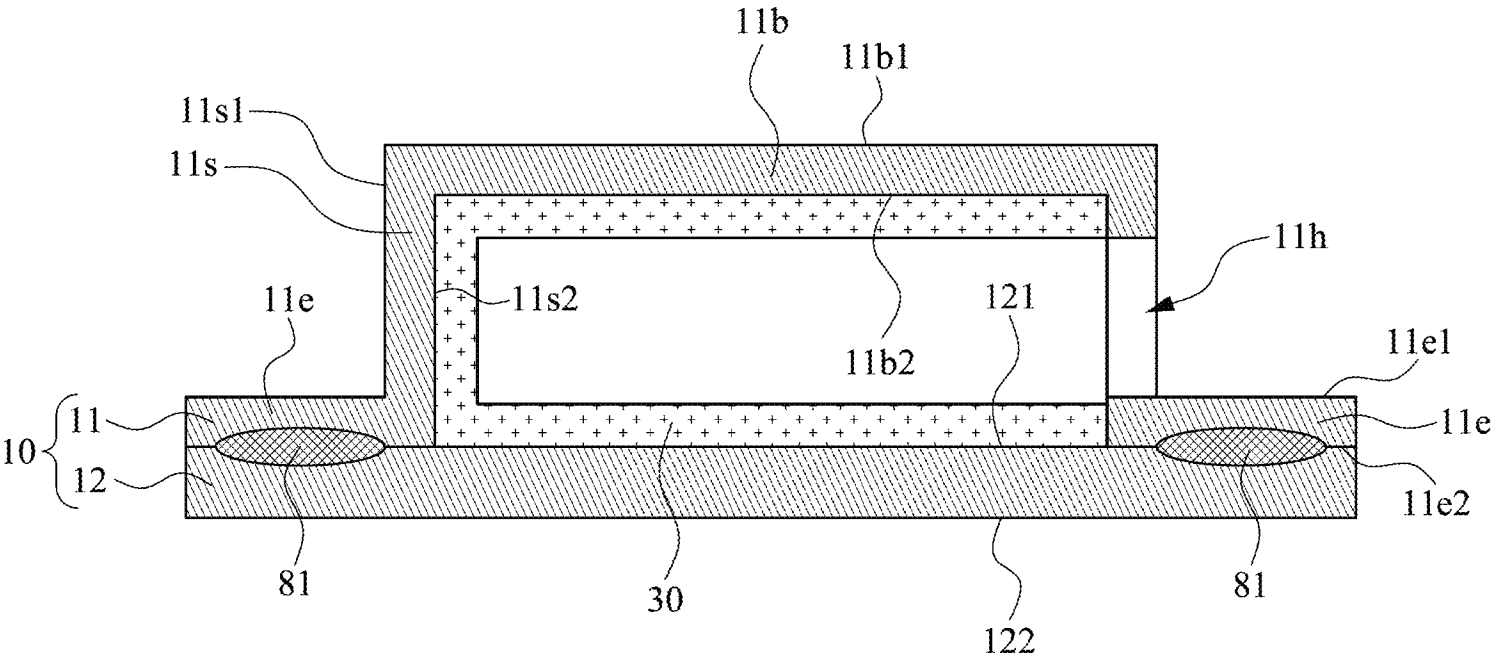

Referring to FIG. 9E, the first portion 11 is sealed or bonded with the second portion 12 to form the housing 10 and define a chamber within the housing 10. The inner surfaces of the housing 10 include the dendritic layer 30. The chamber is completely enclosed by the first portion 11 and the second portion 12 except for the hole 11*h*. The sealing operation may be carried out by laser welding, brazing, soldering or any other suitable method. In some embodiments, a sealant 81, such as solder paste (e.g., tin paste) or copper paste, is used for sealing. In some embodiments, to prevent from the sealant 81 contacts the dendritic layer 30 and flows into the chamber due to capillary action, the sealant 81 is disposed at a position away from the dendritic layer 30 so that the sealant 81 is spaced apart from the dendritic layer 30. In some embodiments, the sealant 81 may be applied onto the edges of the surface 121 of the second portion 12 and/or the surface 11*e*2 of the first portion 11. In some embodiments, the sealant 81 does not fully cover the surface 121 of the second portion 12 or the surface 11*e*2 of the first portion 11 such that it is spaced apart from the dendritic layer 30 within the chamber.

Figure 9F:
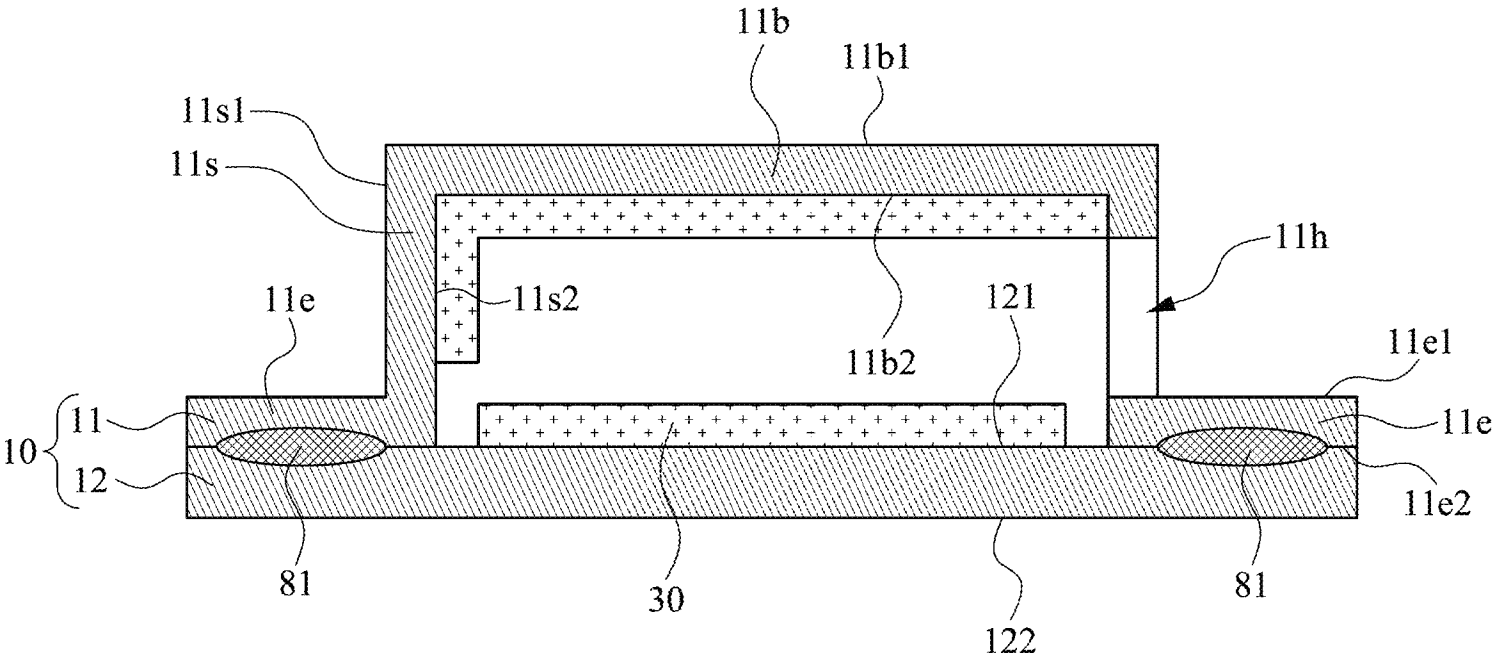

As illustrated in FIG. 9F, in some embodiment, the dendritic layer 30 is spaced apart from an interface where the surface 11*e*2 of the first portion 11 contacts the surface 121 of the second portion 12 to prevent from the sealant 81 contacts the dendritic layer 30 and flows into the chamber. In some embodiments, a corner defined by the surface 11*s*2 of the first portion 11 and the surface 121 of the second portion 12 may be exposed from the dendritic layer 30.

Figure 9G:
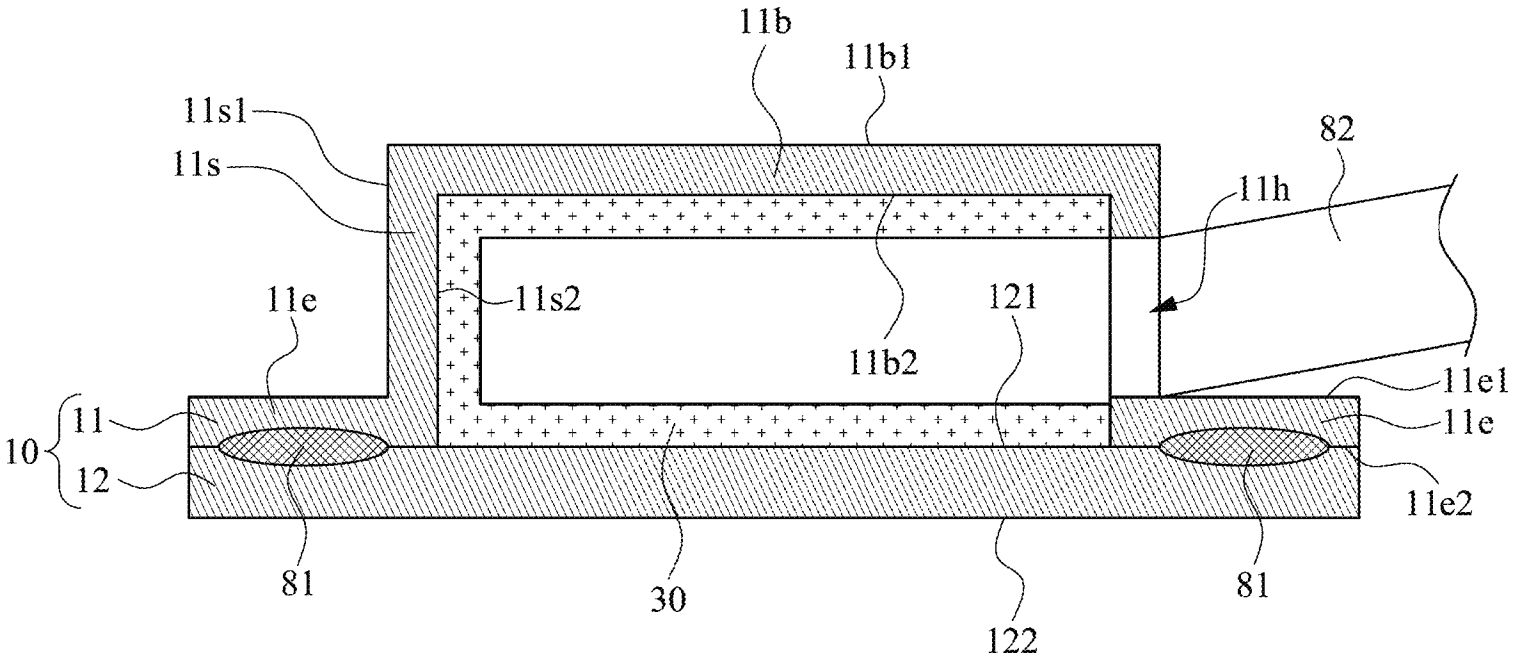

Referring to FIG. 9G, a tube 82 is provided and an end of the tube is attached to the hole 11*h*, e.g., by brazing. The tube 82 is in fluid communication with the chamber within the housing 10. The outer surface of the tube 82 is sealed with the side wall of the hole 11*h*. An optional oxidation or reduction operation may be carried out at an elevated temperature (e.g., 600° C. to 700° C.) for 1 or 2 hours. Then, a working fluid is charged into the chamber after evacuating the gas from the chamber.

Figure 9H:
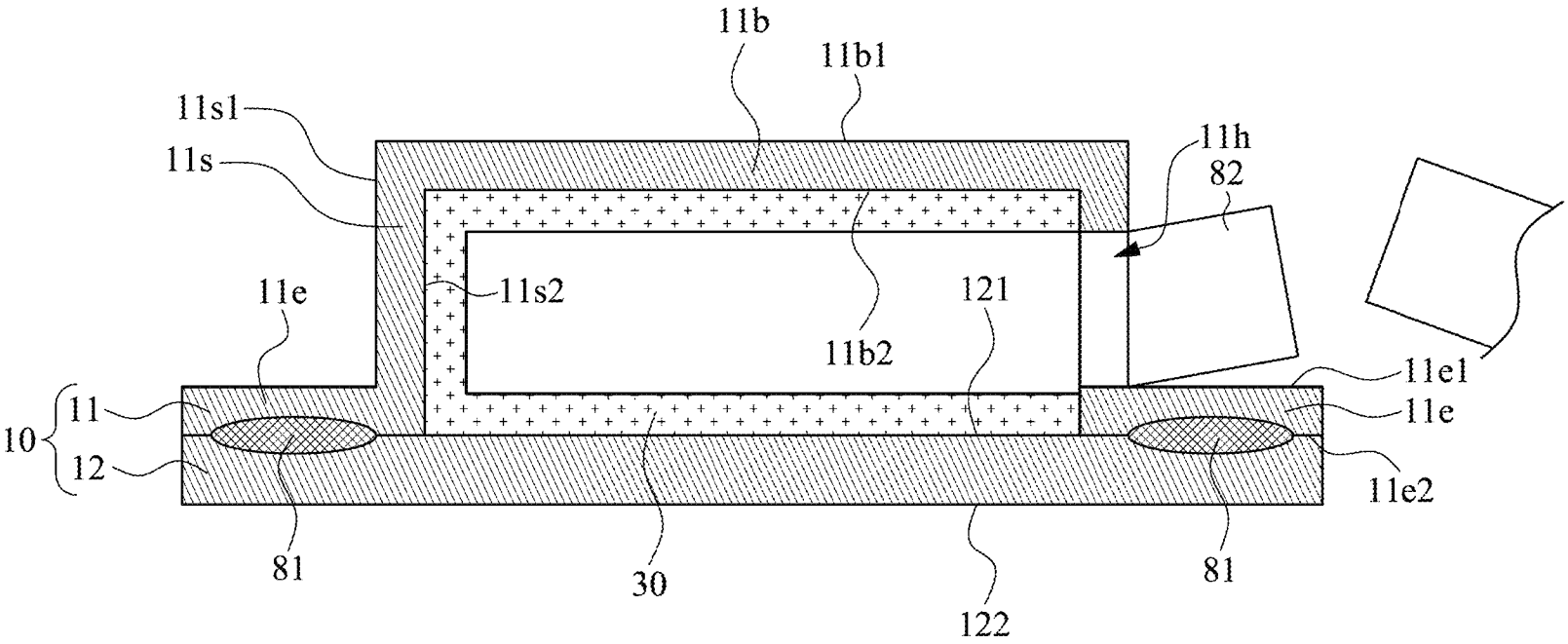

Referring to FIG. 9H, a portion of the tube 82 is pinched off.

Figure 9I:
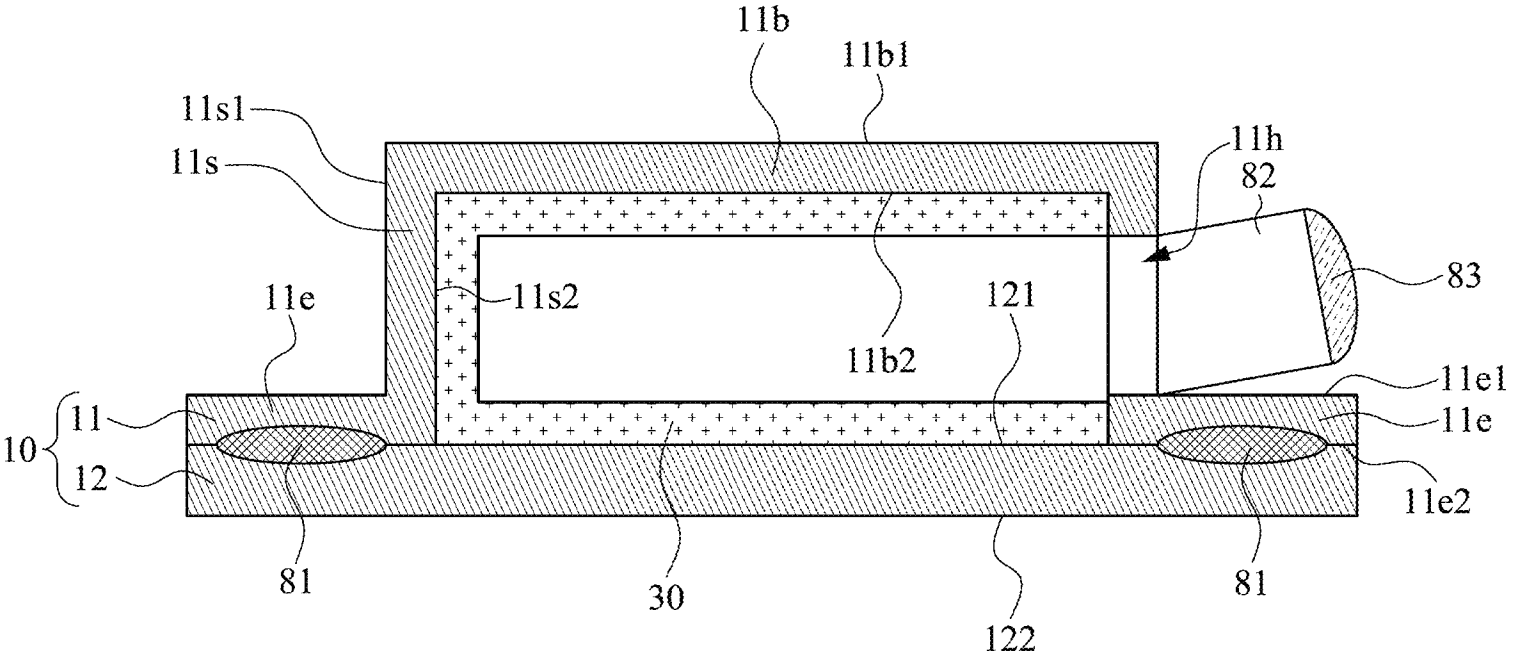

Referring to FIG. 9I, a distal end 83 of the tube 82 is sealed, e.g., by spot welding, so that the camber is isolated from the external environment. The heat transfer element is formed.

Spatial descriptions, such as "above," "below," "up," "left," "right," "down," "top," "bottom view," "vertical," "horizontal," "side," "higher," "lower," "upper," "over," "under," and so forth, are indicated with respect to the orientation shown in the figures unless otherwise specified. It should be understood that the spatial descriptions used herein are for purposes of illustration only, and that practical implementations of the structures described herein can be spatially arranged in any orientation or manner, provided that the merits of the embodiments of this disclosure are not deviated from by such an arrangement.

As used herein, the terms "approximately," "substantially," "substantial" and "about" are used to describe and account for small variations. When used in conjunction with an event or circumstance, the terms can refer to instances in which the event or circumstance occurs precisely as well as instances in which the event or circumstance occurs to a close approximation. For example, when used in conjunction with a numerical value, the terms can refer to a range of variation less than or equal to ±10% of that numerical value, such as less than or equal to ±5%, less than or equal to ±4%, less than or equal to ±3%, less than or equal to ±2%, less than or equal to ±1%, less than or equal to ±0.5%, less than or equal to ±0.1%, or less than or equal to ±0.05%. For example, two numerical values can be deemed to be "substantially" the same or equal if a difference between the values is less than or equal to ±10% of an average of the values, such as less than or equal to ±5%, less than or equal to ±4%, less than or equal to ±3%, less than or equal to ±2%, less than or equal to ±1%, less than or equal to ±0.5%, less than or equal to ±0.1%, or less than or equal to ±0.05%.

Two surfaces can be deemed to be coplanar or substantially coplanar if a displacement between the two surfaces is no greater than 5 μm, no greater than 2 μm, no greater than 1 μm, or no greater than 0.5 μm.

As used herein, the singular terms "a," "an," and "the" may include plural referents unless the context clearly dictates otherwise.

As used herein, the terms "conductive," "electrically conductive" and "electrical conductivity" refer to an ability to transport an electric current. Electrically conductive materials typically indicate those materials that exhibit little or no opposition to the flow of an electric current. One measure of electrical conductivity is Siemens per meter (S/m). Typically, an electrically conductive material is one having a conductivity greater than approximately $10^4$ S/m, such as at least $10^5$ S/m or at least $10^6$ S/m. The electrical conductivity of a material can sometimes vary with temperature. Unless otherwise specified, the electrical conductivity of a material is measured at room temperature.

Additionally, amounts, ratios, and other numerical values are sometimes presented herein in a range format. It should be understood that such range format is used for convenience and brevity and should be understood to flexibly include numerical values explicitly specified as limits of a range, but also to include all individual numerical values or sub-ranges encompassed within that range, as if each numerical value and sub-range is explicitly specified.

While the present disclosure has been described and illustrated with reference to specific embodiments thereof, these descriptions and illustrations are not limiting. It should be understood by those skilled in the art that various changes may be made and equivalents may be substituted without departing from the true spirit and scope of the present disclosure as defined by the appended claims. The illustrations may not necessarily be drawn to scale. There may be distinctions between the artistic renditions in the present disclosure and the actual apparatus due to manufacturing processes and tolerances. There may be other embodiments of the present disclosure which are not specifically illustrated. The specification and drawings are to be regarded as illustrative rather than restrictive. Modifications may be made to adapt a particular situation, material, composition of matter, method, or process to the objective, spirit and scope of the present disclosure. All such modifications are intended to be within the scope of the claims appended hereto. While the methods disclosed herein have been described with reference to particular operations performed in a particular order, it will be understood that these operations may be combined, sub-divided, or re-ordered to form an equivalent method without departing from the teachings of the present disclosure. Accordingly, unless specifically indicated herein, the order and grouping of the operations are not limitations of the present disclosure.

What is claimed is:

1. A heat transfer element, comprising:

a housing including an upper portion and a lower portion, the upper portion including a base and a side wall connected to the base, wherein the side wall contacts the lower portion;

a chamber defined by the upper portion and the lower portion;

a first dendritic layer disposed in the chamber and on an inner lateral surface of the side wall of the upper portion;

a second dendritic layer disposed on an upper surface of the lower portion, and spaced apart from a bottom end surface of the first dendritic layer, wherein a space is collectively defined by the bottom end surface of the first dendritic layer and a lateral end surface of the second dendritic layer, and exposes an interface between the side wall of the upper portion and the lower portion, wherein the bottom end surface of the first dendritic layer at least partially non-overlaps the second dendritic layer vertically; and a hole penetrating a second side wall of the upper portion, wherein the bottom end surface of the first dendritic layer overlaps the hole horizontally.

2. The heat transfer element of claim 1, further comprising a tube connected to the hole, wherein an axis of the tube is non-parallel to the upper surface of the lower portion.

3. The heat transfer element of claim 2, wherein the first dendritic layer includes a portion extending on a lower inner surface of the base of the upper portion and facing the lower portion, wherein the portion of the first dendritic layer overlaps the tube horizontally in a cross-sectional view.

4. The heat transfer element of claim 1, wherein the first dendritic layer includes a portion extending on a lower inner surface of the base of the upper portion and facing the lower portion, wherein the hole has an inner surface substantially aligned with a bottom surface of the portion of the first dendritic layer in a cross-sectional view.

5. A heat transfer element. comprising:

a housing including an upper portion and a lower portion, the upper portion including a base and a side wall connected to the base, wherein the side wall contacts the lower portion, wherein the upper portion further comprises an extension extending from the side wall;

a chamber defined by the upper portion and the lower portion;

a first dendritic layer disposed in the chamber and on an inner lateral surface of the side wall of the upper portion;

a second dendritic layer disposed on an upper surface of the lower portion, and spaced apart from a bottom end surface of the first dendritic layer, wherein a space is collectively defined by the bottom end surface of the first dendritic layer and a lateral end surface of the second dendritic layer, and exposes an interface between the side wall of the upper portion and the lower portion; and a sealant bonding the extension of the upper portion to the lower portion, wherein the sealant laterally overlaps the space, wherein the second dendritic layer includes an upper portion non-overlapping the sealant horizontally, and a lower portion overlapping the sealant horizontally.

6. The heat transfer element of claim 5, wherein a thickness of the sealant is non-uniform.

7. The heat transfer element of claim 6, wherein the sealant includes solder.

8. The heat transfer element of claim 7, wherein a width of the sealant is greater than a thickness of the sealant.

* * * * *